US011019874B2

(12) United States Patent
Bidal et al.

(10) Patent No.: US 11,019,874 B2
(45) **Date of Patent: *Jun. 1, 2021**

(54) GOLF SHOE HAVING OUTSOLE WITH ALL-SURFACE TRACTION ZONES

(71) Applicant: Acushnet Company, Fairhaven, MA (US)

(72) Inventors: Jean-Marie Bidal, Bridgewater, MA (US); John F. Swigart, Portland, OR (US)

(73) Assignee: Acushnet Company, Fairhaven, MA (US)

( * ) Notice: Subject to any disclaimer, the term of this patent is extended or adjusted under 35 U.S.C. 154(b) by 127 days.

This patent is subject to a terminal disclaimer.

(21) Appl. No.: 16/226,861

(22) Filed: Dec. 20, 2018

(65) Prior Publication Data

US 2020/0077734 A1 Mar. 12, 2020

Related U.S. Application Data

(63) Continuation-in-part of application No. 29/662,673, filed on Sep. 7, 2018, now Pat. No. Des. 894,563.

(51) Int. Cl.

| | |
|---|---|
| ***A43B 5/00*** | (2006.01) |
| ***A43B 13/22*** | (2006.01) |
| ***A43C 15/16*** | (2006.01) |
| ***A43B 13/04*** | (2006.01) |
| ***A43B 13/12*** | (2006.01) |

(52) U.S. Cl.

CPC ..... *A43B 5/001* (2013.01); *A43B 13/04* (2013.01); *A43B 13/122* (2013.01); *A43B 13/125* (2013.01); *A43B 13/223* (2013.01); *A43C 15/162* (2013.01)

(58) Field of Classification Search

CPC ..... A43B 3/0036; A43B 5/001; A43B 5/02; A43B 13/22; A43B 13/223; A43C 15/16; A43C 15/162; A43C 15/165; A43C 15/18

See application file for complete search history.

(56) References Cited

U.S. PATENT DOCUMENTS

| | | | | |
|---|---|---|---|---|
| D259,595 | S * | 6/1981 | Famolare, Jr. | D2/955 |
| 4,571,852 | A * | 2/1986 | Lamarche | A43B 3/0042 36/25 R |
| 4,782,604 | A | 11/1988 | Wen-Shown | |

(Continued)

FOREIGN PATENT DOCUMENTS

| | | |
|---|---|---|
| WO | WO 9922516 | 5/1999 |

*Primary Examiner* — Sharon M Prange

(74) *Attorney, Agent, or Firm* — Kristin D. Wheeler

(57) ABSTRACT

Golf shoes having improved outsole constructions are provided. The golf shoes include upper, midsole, and outsole sections. The outsole includes a first set of arc pathways extending along the outsole in one direction. A second set of arc pathways extend along the outsole in a second direction. When the first and second arc pathways are superposed over each other, four-sided tile pieces are formed, and these tiles contain protruding traction members. Different traction zones containing different traction members are provided on the outsole. These zones provide improved all surface traction and there is no channeling and no trenching of the golf course turf. There is less damage to the golf course for a given amount of traction.

12 Claims, 16 Drawing Sheets

(56) References Cited

U.S. PATENT DOCUMENTS

| | | | | |
|---|---|---|---|---|
| 6,665,961 | B2 * | 12/2003 | Kobayashi | A43B 5/001 36/127 |
| 6,792,698 | B2 * | 9/2004 | Kobayashi | A43B 5/001 36/127 |
| 6,948,264 | B1 | 9/2005 | Lyden | |
| 7,762,009 | B2 * | 7/2010 | Gerber | A43B 13/26 36/59 C |
| 7,895,773 | B2 | 3/2011 | Robinson, Jr. et al. | |
| 8,011,118 | B2 | 9/2011 | Gerber | |
| 8,256,146 | B2 * | 9/2012 | Loverin | A43B 13/145 36/102 |
| 8,677,657 | B2 | 3/2014 | Bacon et al. | |
| 9,332,803 | B2 | 5/2016 | Kasprzak | |
| 10,004,294 | B2 * | 6/2018 | Swegle | A43B 13/223 |

* cited by examiner

FIG. 4B (TABLE 1)

FIG. 4C (TABLE 2)

GOLF SHOE HAVING OUTSOLE WITH ALL-SURFACE TRACTION ZONES

CROSS-REFERENCE TO RELATED APPLICATIONS

This application is a continuation-in-part of co-pending, co-assigned U.S. patent application Ser. No. 29/662,673, filed on Sep. 7, 2018, the entire disclosure of which is incorporated by reference.

BACKGROUND OF THE INVENTION

Field of the Invention

The present invention relates generally to shoes and more particularly to golf shoes having improved outsoles. The outsole has different regions or zones of traction members that provide traction for on-course and off-course activities. The traction members are arranged on the outsole in a non-channeled pattern. The traction members and their distinct pattern on the outsole help provide a shoe with high traction and low turf-trenching properties. The outsole further minimizes damage to putting greens for the given amount of traction.

Brief Review of the Related Art

Both professional and amateur golfers use specially designed golf shoes today. Typically, the golf shoe includes an upper portion and outsole portion along with a mid-sole connecting the upper to the outsole. The upper has a traditional shape for inserting a user's foot and thus covers and protects the foot in the shoe. The upper is designed to provide a comfortable fit around the contour of the foot. The mid-sole is relatively lightweight and provides cushioning to the shoe. The outsole is designed to provide stability and traction for the golfer. The bottom surface of the outsole may include spikes or cleats designed to engage the ground surface through contact with and penetration of the ground. These elements help provide the golfer with better foot traction as he/she walks and plays the course.

Often, the terms, "spikes" and "cleats" are used interchangeably in the golf industry. Some golfers prefer the term, "spikes," since cleats are more commonly associated with other sports such as baseball, football, and soccer. Other golfers like to use the term, "cleats" since spikes are more commonly associated with non-turf sports such as track or bicycling. In the following description, the term, "spikes" will be used for convenience purposes. Golf shoe spikes can be made of a metal or plastic material. However, one problem with metal spikes is they are normally elongated pieces with a sharp point extending downwardly that can break through the surface of the putting green thereby leaving holes and causing other damage. These metal spikes also can cause damage to other ground surfaces at a golf course, for example, the carpeting and flooring in a clubhouse. Today, most golf courses require that golfers use non-metal spikes. Plastic spikes normally have a rounded base having a central stud on one face. On the other face of the rounded base, there are radial arms with traction projections for contacting the ground surface. Screw threads are spaced about the stud on the spike for inserting into a threaded receptacle on the outsole of the shoe as discussed further below. These plastic spikes, which can be easily fastened and later removed from the locking receptacle on the outsole, tend to cause less damage to the greens and clubhouse flooring surfaces.

If spikes are present on the golf shoe, they are preferably detachably fastened to receptacles (sockets) in the outsole. The receptacles may be located in a molded pod attached to the outsole. The molded pods help provide further stability and balance to the shoe. The spike may be inserted and removed easily from the receptacle. Normally, the spike may be secured in the receptacle by inserting it and then slightly twisting it in a clockwise direction. The spike may be removed from the receptacle by slightly twisting it in a counter-clockwise direction.

In recent years, "spikeless" or "cleatless" shoes have become more popular. These shoe outsoles contain rubber or plastic traction members but no spikes or cleats. These traction members protrude from the bottom surface of the outsole to contact the ground. The shoes are designed for on the golf course and off the course. That is, the shoes provide good stability and traction for the golfer playing the course including on the tees, fairways, and greens. Furthermore, the shoes are lightweight, and comfortable and can be used off the golf course. The shoes can be worn comfortably in the clubhouse, office, or other off-course places.

When a golfer swings a club and transfers his/her weight, their foot absorbs tremendous forces. For example, when a right-handed golfer is first planting his/her feet before beginning any club swinging motion (that is, when addressing the ball), their weight is evenly distributed between their front and back feet. As the golfer begins their backswing, their weight shifts primarily to their back foot. Significant pressure is applied to the back foot at the beginning of the downswing. Thus, the back foot can be referred to as the driving foot and the front foot can be referred to as the stabilizing foot. As the golfer follows through with their swing and drives the ball, their weight is transferred from the driving foot to the front (stabilizing) foot. During the swinging motion, there is some pivoting at the back and front feet, but this pivoting motion must be controlled. It is important the feet do not substantially move or slip when making the shot. Good foot traction is important during the golf shot cycle. Thus, traditional golf shoes have traction members and spikes positioned at different locations across the outsole.

For example, Bacon et al., U.S. Pat. No. 8,677,657 discloses a golf shoe outsole having hard thermoplastic polyurethane pods molded to a relatively soft and flexible thermoplastic polyurethane in the forward section and molded to a relatively hard TPU in the heel section. Each pod contains a cleat receptacle for inserting and removing cleats. Robinson, Jr. et al., U.S. Pat. No. 7,895,773 discloses a golf shoe having a collapsible and supportable gel pad contained in a recess of the outsole proximate to the metatarsal bone. The shoe includes relatively soft plastic spikes that can be replaced and relatively hard rubber cleats that cannot be replaced. After a given time period (for example, 3 months), and the replacement spikes have worn down, the golfer can replace them to restore traction. If the golfer wishes, he/she can choose the height of the replacement spike to match the height of the non-replaceable cleats which also may have worn down.

In other examples, the outsole may contain traction members, spikes, and/or cleats that are arranged in linear patterns with transverse and longitudinal rows extending across the outsole. For instance, Wen-Shown, U.S. Pat. No. 4,782,604 discloses a golf shoe outsole having multiple removable metal spikes (nails) and multiple soft cleats arranged in a linear pattern. The metal cleats are positioned in the ball portion and heel portion of the outsole. The soft cleats are positioned around the sole for the purpose of positioning, bearing load, and providing elasticity.

Kasprzak, U.S. Pat. No. 9,332,803 discloses a golf shoe outsole having cleats distributed along the forefoot and heel areas. The cleats are arranged in transverse rows along a longitudinal length of the outsole. The cleats are essentially cross-shaped. The forefoot includes a ball area and toe area. The ball area and the heel area have cleats with greater heights and widths than other areas of the sole. The cleats along the ball area and the heel area are substantially equal in height.

In another version, the traction members are arranged in circular patterns, where each traction element that is positioned in a ring has substantially the same radius and center as the other traction element in the ring. For example, Gerber, U.S. Pat. No. 8,011,118 discloses a shoe having an outsole with a circular tread pattern. The circular tread pattern includes a first circular tread having a first radius, wherein the first circular tread extends less than 360 degrees in a circumferential direction around a center of the circular tread pattern. The circular tread pattern also includes a second circular tread having a second radius greater than the first; and where the second circular tread also extends less than 360 degrees in a circumferential direction around a center of the circular tread. According to the '118 Patent, the circular tread pattern provides sufficient traction in all directions but also allows the wearer to pivot about a pivot portion.

However, one drawback with some conventional golf shoes is these shoes can damage the golf course turf. For example, the traction members, spikes, and cleats can drag along the surface damaging grass blades and roots. This damage can be referred to as a trenching effect. This tearing-up of the grass and roots makes the putting green and other course surfaces uneven. There are relatively raised and lowered surfaces and this leads to discoloration and browning of the turf. The penetration of the ground surface and trenching of the turf by the shoe outsole causes problems for the golfer in all phases of the game. For example, turf-trenching can affect the golfer when he/she is driving the ball from the tee, making shots on the fairway, and putting on the greens, and even when walking the course. Even if golfers are careful, they can cause damage to the greens when walking and putting. Particularly, this is a problem when the putting greens are wet. The trenching of grass and soil can slow the overall flexibility and pivoting action of the shoe. Also, the digging-up and clogging of turf in the outsole can make the golfer feel awkward and uncomfortable when walking the course or swinging the club to make a shot. When traction members and cleats are arranged in a linear configuration across the outsole, this turf-trenching effect occurs in both the 90 degree and 0 degree directions as discussed in further detail below. On the other hand, when cleats are arranged in overlapping circular patterns (double-radial configuration), there tends to be little turf-trenching in the 90 degree directions, but there is more turf-trenching in the 0 degree directions. In yet another embodiment, when the cleats are arranged in a concentric circular pattern, there can be trenching in various directions including the rotational direction as also discussed in further detail below.

Thus, there is a need for a golf shoe having an improved outsole that can provide a high level of stability and traction. The shoe should hold and support the medial and lateral sides of the golfer's foot as they shift their weight when making a golf shot. The shoe should provide good traction so there is no slipping and the golfer can stay balanced. At the same time, the outsole of the shoe should have minimal turf-trenching properties. A golfer wearing the shoe should be able to comfortably walk and play the course with minimal damage to the course turf. The present invention provides new golf shoe constructions that provide improved traction to the golfer as well as other advantageous properties, features, and benefits including minimal turf trenching properties.

SUMMARY OF THE INVENTION

The present invention provides a golf shoe having an outsole comprising different zones of tiles. Each zone contains different traction members for gripping both golf course and off-golf course surfaces. The traction members are arranged on the outsole in a non-channeled pattern. The traction members and their distinct pattern on the outsole help provide a shoe with high traction and minimal turf-trenching properties. The outsole further minimizes damage to putting greens and other surfaces such as clubhouse flooring. The shoes provide less damage to the golf course for a given amount of traction.

The shoe includes an upper portion and outsole portion along with a midsole connecting the upper to the outsole. Looking at the bottom surface of the outsole, it contains sets of spiral pathways that intersect each other. For example, one set of spiral pathways can be referred to as Set A; and the other set can be referred to as Set B. Each spiral pathway in Set A has a common point of origin and contains a plurality of spiral segments radiating from that point. Each spiral segment in Set A has a different degree of curvature. Similar to the A set of spiral pathways, each spiral pathway in set B has a common point of origin and contains a plurality of spiral segments radiating from that point. Each spiral segment in Set B also has a different degree of curvature. The first set of spiral pathways (A) is logarithmic or normal, and the second set of spiral pathways (B) is an inverse of the first set (A). Thus, the sets of spiral pathways (A) and (B) can be superposed over each other. When the spiral pathways in sets (A) and (B) are superposed over each other, the curved sub-segments of spiral segments from set A and the curved sub-segments of spiral segments from set B are pieced together to create four-sided tile pieces. The intersecting points between the superposed sets of spiral pathways (A) and (B) form the corners of these tile pieces. In the outsole of this invention, these tile pieces contain projecting traction members.

For example, looking at the outsole of a right shoe, the forefoot region of the outsole includes a first (lateral) zone of tiles containing protruding traction members extending along the periphery of the forefoot region. These traction members in the lateral zone are primarily used for golf-specific traction, that is, these traction members help control forefoot lateral traction, and prevent the foot from slipping during a golf shot. A third (medial) zone of tiles contains protruding traction members extending along the opposing periphery of the forefoot region. These traction members in the medial zone provide a high contact surface area to prevent slipping on hard, wet, and smooth surfaces. All of the traction members provide maximum contact with the ground surface for the given amount of traction member material (for example, rubber) in that specific zone. A second (middle) zone of tiles containing protruding traction members is disposed between the first and third zones. These traction members in the middle zone are relatively softer and more compliant than the traction members in the neighboring lateral and medial zones. These traction members provide comfort and tend to distribute pressure from the middle (second) zone out to the periphery of the sole, that is, toward the lateral (first) and medial (third) zones. Thus, the middle zone acts as a comfort zone relieving the pressure placed on the center of the sole and pushing it to the lateral and medial sides of the sole. The pattern of the traction members in the lateral and medial zones provides improved traction on both hard and soft surfaces as discussed further below. In one preferred embodiment, the traction members are made from a rubber material and the traction members in all of the zones provide maximum gripping power per volume of rubber material used. The mid-foot and rear-foot regions of the outsole include similar zones and traction members as discussed further below.

There also can be an oval pattern (OV1) having a center point superposed on the spiral pathways, the center point of the oval pattern (OV1) and the point of origin of the first set of spiral pathways (A) being the same fixed point; wherein the first segment in each spiral pathway has a proximal end and distal end, and the oval pattern intersects the distal ends of the first segments. There also can be an oval pattern (OV2) having a center point superposed on the spiral pathways, the center point of the oval pattern (OV2) and the point of origin of the second set of spiral pathways (B) being the same fixed point; wherein the second segment in each spiral pathway has a proximal end and distal end, and the oval pattern intersects the distal ends of the second segments.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

FIG. 4B is Table 1 showing the length of the spiral pathway segments as shown in FIG. 4A, and their respective growth factor;

FIG. 4C is Table 2 showing the length of the spiral pathway segments as shown in FIG. 4A, and their respective growth factor in a geometrical equation;

DETAILED DESCRIPTION OF THE INVENTION

Figure 1:
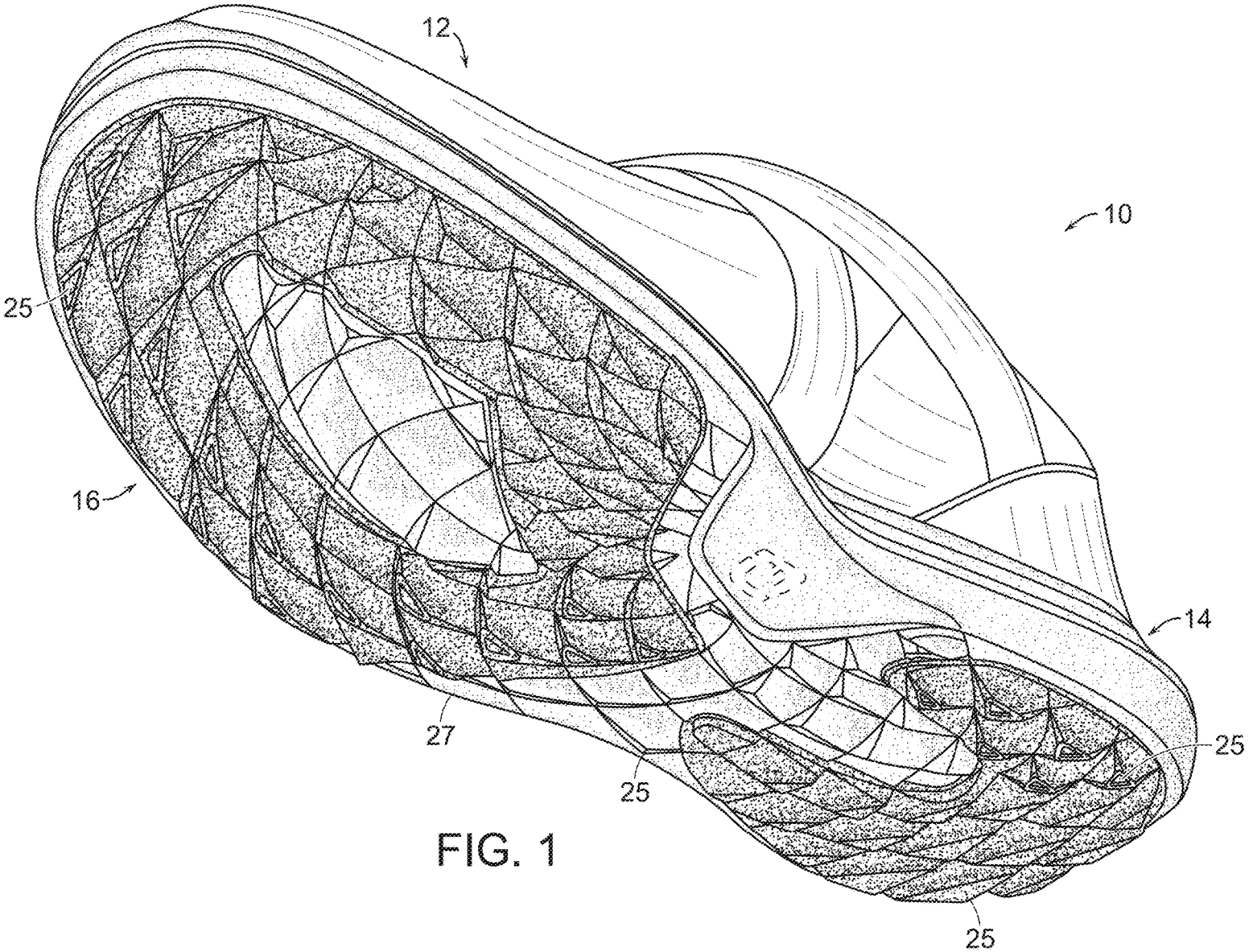
FIG. 1 is a perspective view of one embodiment of a golf shoe of the present invention showing the outsole in detail.

Referring to the Figures, where like reference numerals are used to designate like elements, and particularly FIG. 1, one embodiment of the golf shoe (10) of this invention is shown. The shoe (10) includes an upper portion (12) and outsole portion (16) along with a midsole (14) connecting the upper (12) to the outsole (16). The views shown in the Figures are of a right shoe and it is understood the components for a left shoe will be mirror images of the right shoe. It also should be understood that the shoe may be made in various sizes and thus the size of the components of the shoe may be adjusted depending upon the shoe size.

Figure 1A:
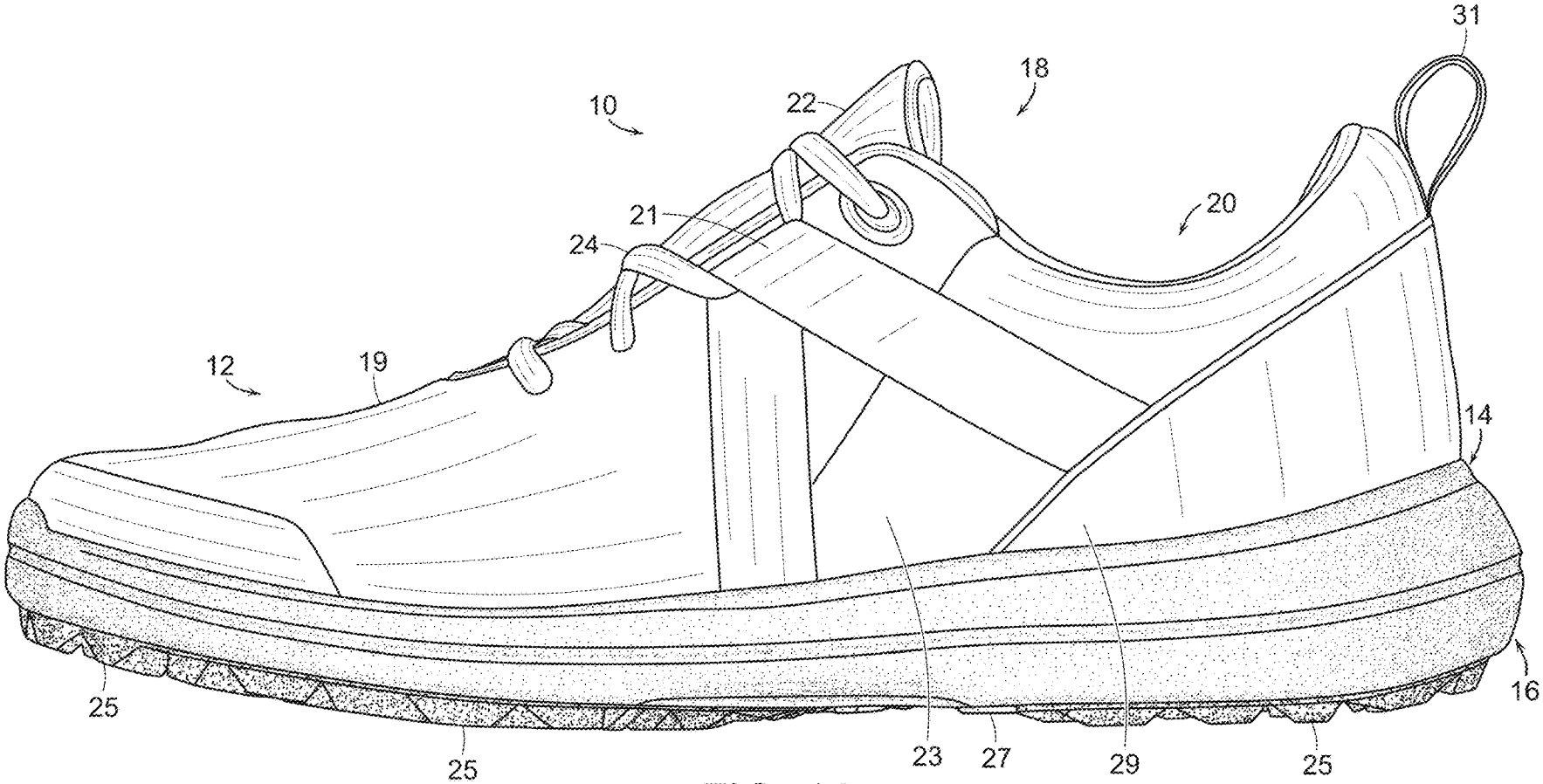
FIG. 1A is a medial side view of one embodiment of a golf shoe of the present invention showing the upper in detail.

The upper (12) has a traditional shape and is made from a standard upper material such as, for example, natural leather, synthetic leather, non-woven materials, natural fabrics, and synthetic fabrics. For example, breathable, mesh, and synthetic textile fabrics made from nylons, polyesters, polyolefins, polyurethanes, rubbers, and combinations thereof can be used. The material used to construct the upper is selected based on desired properties such as breathability, durability, flexibility, and comfort. In one preferred example, the upper (12) is made of a mesh material. The upper material is stitched or bonded together to form an upper structure. Referring to FIG. 1A, the upper (12) generally includes an instep region (18) with an opening (20) for inserting a foot. The upper includes a vamp (19) for covering the forepart of the foot. The instep region includes a tongue member (22) and a saddle strip (21) overlying the quarter section (23) of the upper and attached to the foxing (29) in the heel region. The upper (12) may include an optional ghillie strap (31) extending from the rear area of the instep region (18). Normally, laces (24) are used for tightening the shoe around the contour of the foot. However, other tightening systems can be used including metal cable (lace)-tightening assemblies that include a dial, spool, and housing and locking mechanism for locking the cable in place. Such lace tightening assemblies are available from Boa Technology, Inc., Denver, Colo. 80216. It should be understood that the above-described upper (12) shown in FIGS. 1 and 1A represents only one example of an upper design that can be used in the shoe construction of this invention and other upper designs can be used without departing from the spirit and scope of this invention.

The midsole (14) is relatively lightweight and provides cushioning to the shoe. The midsole (14) can be made from a standard midsole material such as, for example, foamed ethylene vinyl acetate copolymer (EVA) or polyurethane. In one manufacturing process, the midsole (14) is molded on and about the outsole. Alternatively, the midsole (14) can be molded as a separate piece and then joined to the top surface (not shown) of the outsole (16) by stitching, adhesives, or other suitable means using standard techniques known in the art. For example, the midsole (14) can be heat-pressed and bonded to the top surface of the outsole (16).

In general, the outsole (16) is designed to provide stability and traction for the shoe. The bottom surface (27) of the outsole (16) includes multiple traction members (25) to help provide traction between the shoe and grass on the course. The bottom surface of the outsole and traction members can be made of any suitable material such as rubber or plastics and combinations thereof. Thermoplastics such as nylons, polyesters, polyolefins, and polyurethanes can be used. Suitable rubber materials that can be used include, but are not limited to, polybutadiene, polyisoprene, ethylene-propylene rubber ("EPR"), ethylene-propylene-diene ("EPDM") rubber, styrene-butadiene rubber, styrenic block copolymer rubbers (such as "SI", "SIS", "SB", "SBS", "SIBS", "SEBS", "SEPS" and the like, where "S" is styrene, "I" is isobutylene, "E" is ethylene, "P" is propylene, and "B" is butadiene), polyalkenamers, butyl rubber, nitrile rubber, and blends of two or more thereof. The structure and functionality of the outsole (16) of the present invention is described in further detail as follows.

Figures 2A, 2B, 2C:
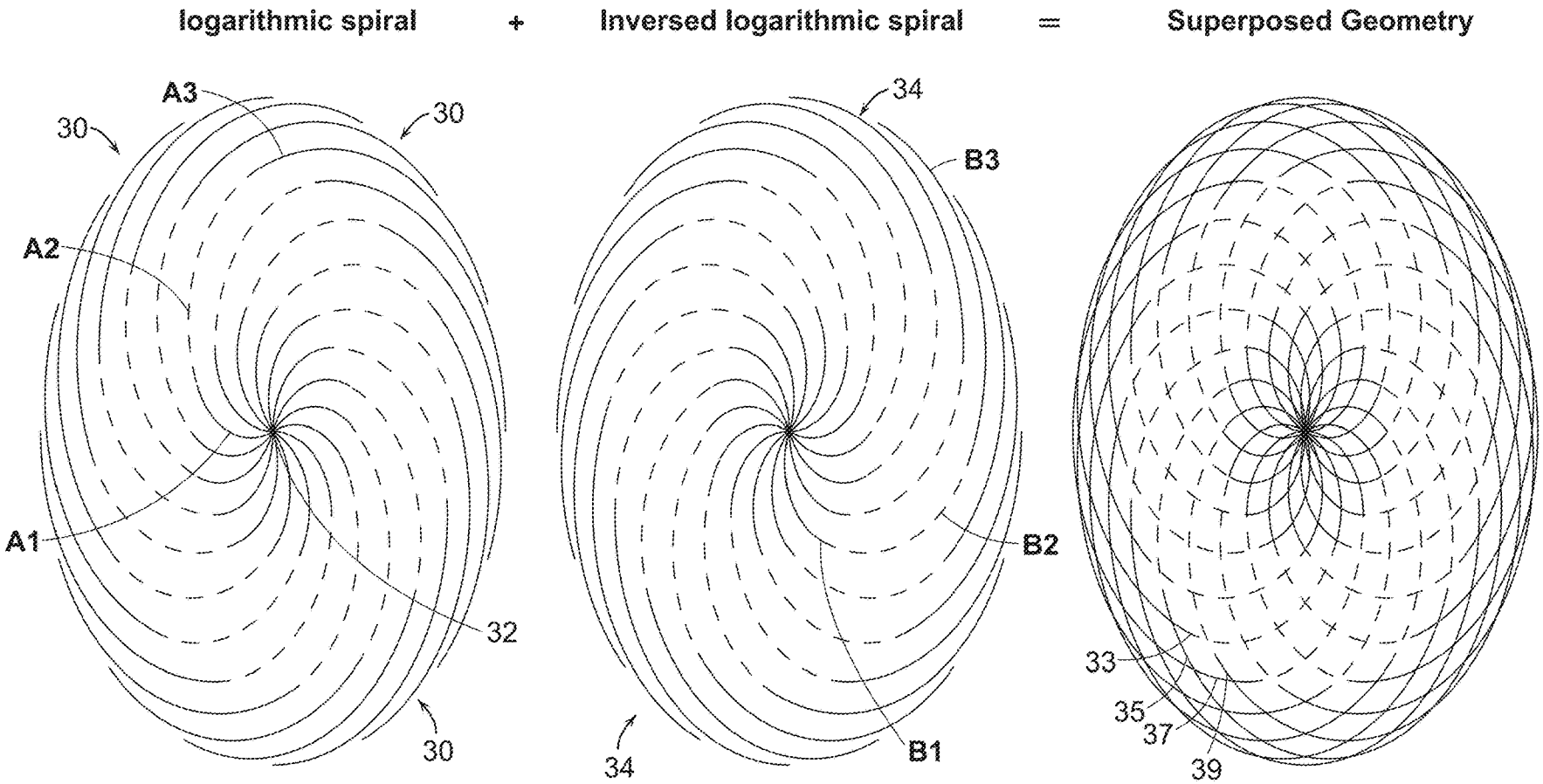
FIG. 2A is a top plan view of a first set of logarithmic (normal) spiral pathways (A) for one embodiment of a golf shoe of the present invention.
FIG. 2B is a top plan view of a second set of logarithmic (inversed) spiral pathways (B) and is an inverse of the first set of logarithmic (normal) spiral pathways (A) shown in FIG. 2A.
FIG. 2C is a top plan view of the second set of logarithmic (inversed) spiral pathways (B) shown in FIG. 2B superposed over the first set of logarithmic (normal) spiral pathways (A) shown in FIG. 2A.

In FIG. 2A, a first set of spiral pathways (A) is shown. Each spiral pathway (30) has a common point of origin (32) and contains a plurality of spiral segments (for example, A1, A2, and A3) radiating from that point (32). Each segment (A1, A2, and A3) has a different degree of curvature. Turning to FIG. 2B, a second set of spiral pathways (B) is shown. Similar to the (A) set of spiral pathways, each spiral pathway (34) in set (B) has a common point of origin (36) and contains a plurality of spiral segments (for example, B1, B2, and B3) radiating from that point (36). Each segment (B1, B2, and B3) has a different degree of curvature. The first set of spiral pathways (A) is logarithmic or normal, and the second set of spiral pathways (B) is an inverse of the first set (A). Thus, the sets of spiral pathways (A) and (B) can be superposed over each other as shown in FIG. 2C.

When the spiral pathways in sets (A) and (B) are superposed over each other, the curved sub-segments of spiral segments from set A and the curved sub-segments of spiral segments from set B are pieced together to create four-sided tile pieces. In FIG. 2C, a four-sided tile having spiral sub-segment sides (33, 35, 37, and 39) is shown. The intersecting points between the superposed sets of spiral pathways (A) and (B) form the corners of these tile pieces. In the shoe of this invention, these tile pieces are positioned on the outsole and contain projecting traction members—they are described in further detail below.

Figure 3B:
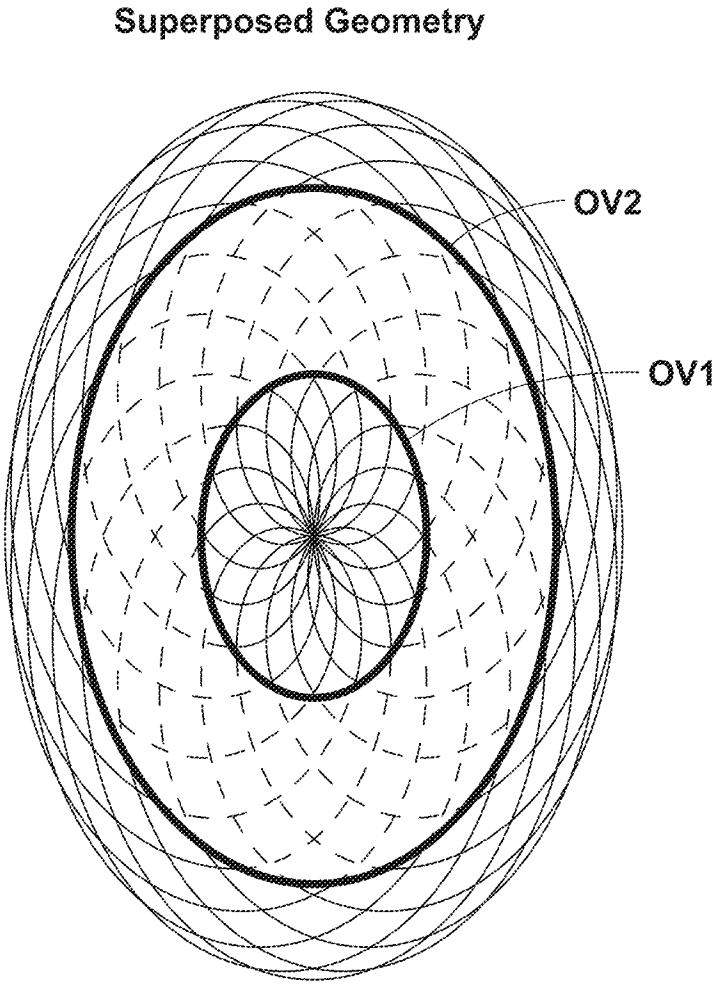
FIG. 3B is a top plan view of the superposed first set of logarithmic (normal) spiral pathways (A) and second set of logarithmic (inversed) spiral pathways (B) as shown in FIG. 2C with oval pattern (OV1) and oval pattern (OV2) overlying the superposed spiral pathways with the understanding that these oval patterns are for illustration purposes only and do not appear as visible marks or indicia on the outsole of the shoe.
Figure 3A:
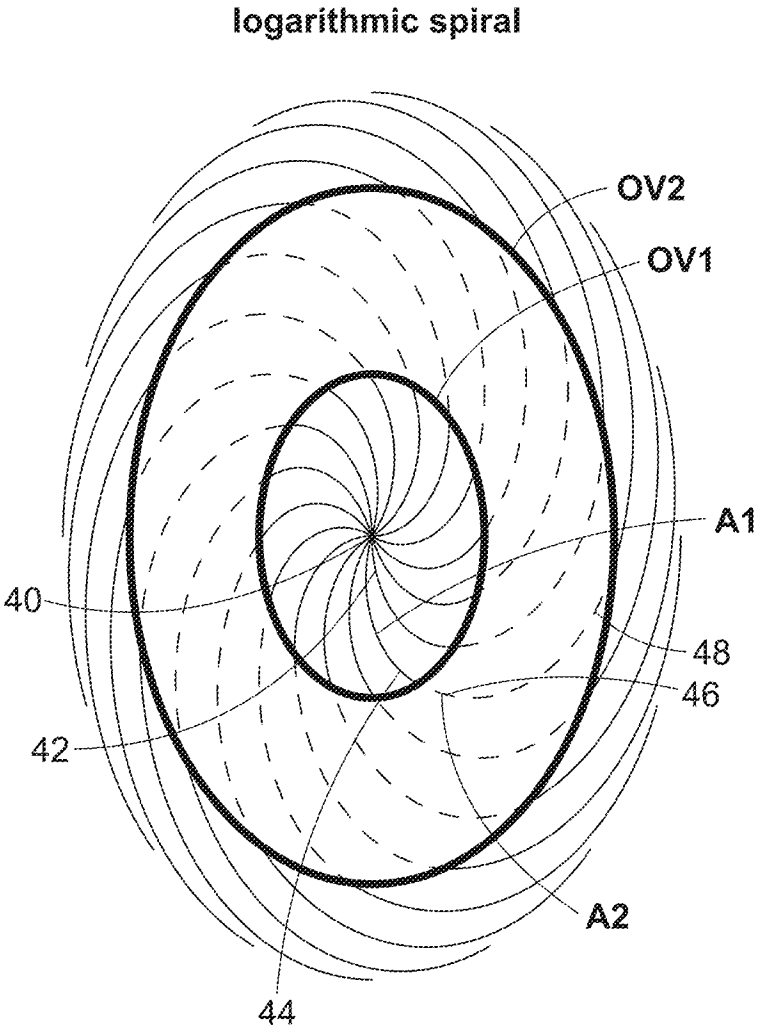
FIG. 3A is a top plan view of a first set of logarithmic (normal) spiral pathways (A) shown in FIG. 2A with oval pattern (OV1) and oval pattern (OV2) overlying the spiral pathways with the understanding that these oval patterns are for illustration purposes only and do not appear as visible marks or indicia on the outsole of the shoe.

The geometry of the spiral pathways is shown in further detail in FIG. 3A. In this view, the first set of logarithmic (normal) spiral pathways (A) (FIG. 2A) includes oval pattern (OV1) and oval pattern (OV2) intersecting the different spiral pathways. It should be understood that the oval patterns (OV1 and OV2) are used herein to further describe the spiral pathways (A and B) and are intended for illustration purposes only. The oval patterns (OV1 and OV2) do not appear as visible marks or indicia on the outsole of the shoe. More particularly, the oval pattern (OV1) has a center point (40), and, as shown in FIG. 3A, the center point (40) of the oval pattern (OV1) and point of origin (32) of the first segment (A1) of spiral pathway (A) are the same fixed point. The first segment (A1) in each spiral pathway (A) also has a proximal end (42) and distal end (44). The oval pattern (OV1) intersects the distal ends (44) of the first segments (A1) of spiral pathway (A).

As further shown in FIG. 3A, an oval pattern (OV2) having the same center point (40) also overlies the spiral pathways (A). The center point of the oval pattern (OV2) and the point of origin (32) of the second segment (A2) of spiral pathway (A) are the same fixed point. The second segment (A2) in each spiral pathway (A) also has a proximal end (46) and distal end (48). The oval pattern (OV2) intersects the distal ends (48) of the second segments (A2) of the spiral pathways (A).

The first set of logarithmic (normal) spiral pathways (A) and second set of logarithmic (inversed) spiral pathways (B), which are superposed over each other as shown in FIG. 2C, are shown with overlying and intersecting oval patterns (OV1 and OV2) for illustration purposes in FIG. 3B. It should be understood that the number of spiral pathways in the pattern and number of spiral segments in a given spiral pathway is unlimited. In FIGS. 3A and 3B, a spiral pathway containing three spiral segments (A1, A2, and A3) is shown for illustration purposes, but there can be an ad infinitum number of segments and these segments can be scaled to any size as described further below.

Figure 4A:
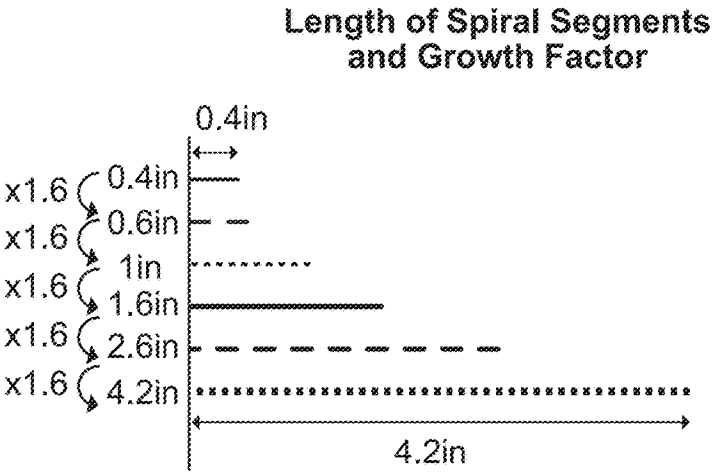
FIG. 4A is a top plan view of one example of a first set of logarithmic (normal) spiral pathways (A) showing a spiral pathway containing different spiral pathway segments, wherein the length of the spiral segments increases by a growth factor.
Figure 4A:
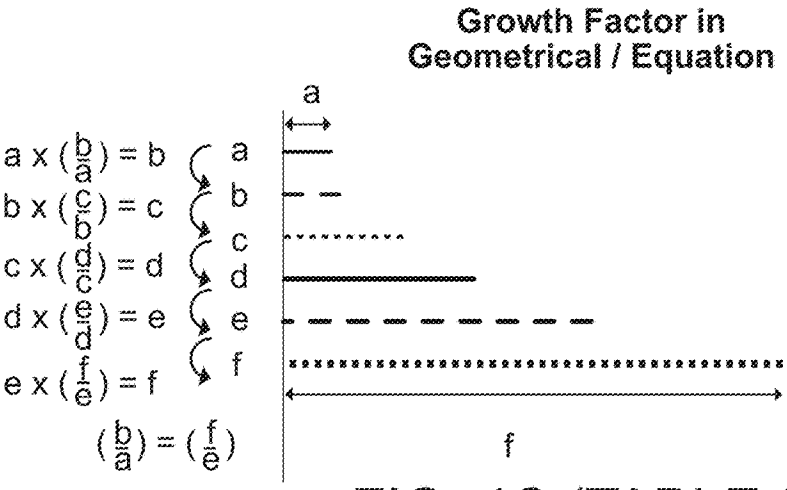
Figure 4A:
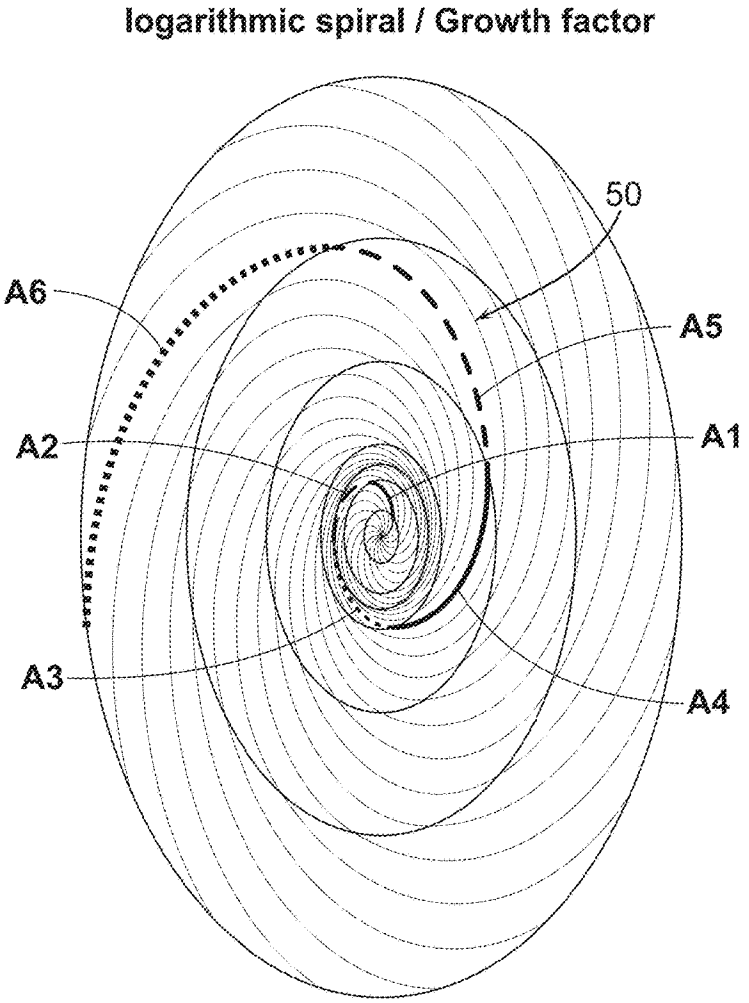

Referring to FIGS. 4A-4C, the path lengths of some exemplary spiral segments comprising the spiral pathways are shown in more detail. In FIG. 4A, one example of a first set of logarithmic (normal) spiral pathways (A) with a spiral pathway containing multiple spiral segments is shown. The length of the spiral path segments increases by a constant growth factor. In particular, for this example, the spiral pathway (50) comprises a first spiral segment (A1); a second spiral segment (A2); a third spiral segment (A3); a fourth spiral segment (A4); a fifth spiral segment (A5); and a sixth spiral segment (A6). These spiral segments increase by a constant growth factor along the entire spiral pathway. For example, if the length of the spiral segment A1 is 0.4 inches; and the length of spiral segment A2 is 0.6 inches; and the length of spiral segment A3 is 1 inch, the growth factor is 1.6. This growth factor of the different segments stays the same as the spiral pathway continues to grow as shown in Table 1 of FIG. 4B. That is, the growth factor stays consistent (for example, the growth factor can be 1.6) throughout the full spiral pathway. This example of a growth factor can be expressed in a geometrical equation as shown in Table 2 of FIG. 4C. As shown in FIGS. 4A-4C, there can be multiple spiral segments and there can be multiple oval patterns intersecting the different segments of the spiral pathways.

Figure 5B:
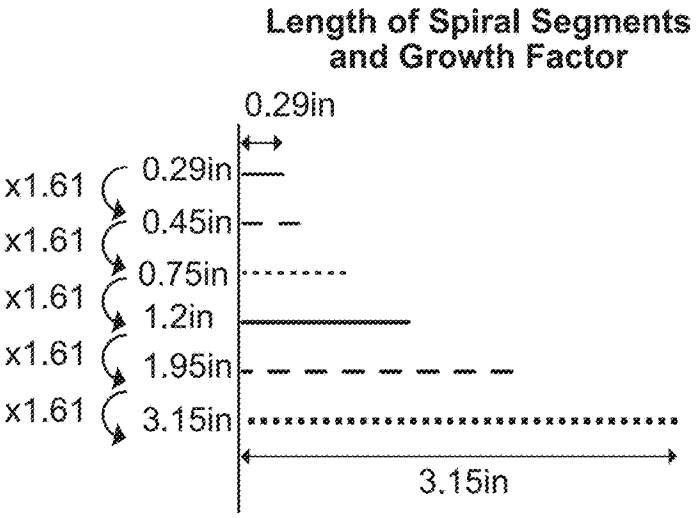
FIG. 5B is Table 3 showing the length of the spiral pathway segments as shown in FIG. 5A, and their respective growth factor.
Figure 5C:
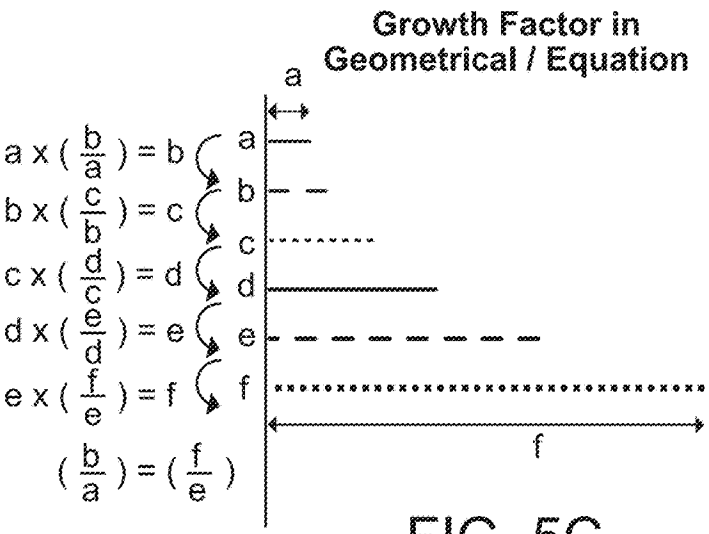
FIG. 5C is Table 4 showing the length of the spiral pathway segments as shown in FIG. 5A, and their respective growth factor in a geometrical equation.
Figure 5A:
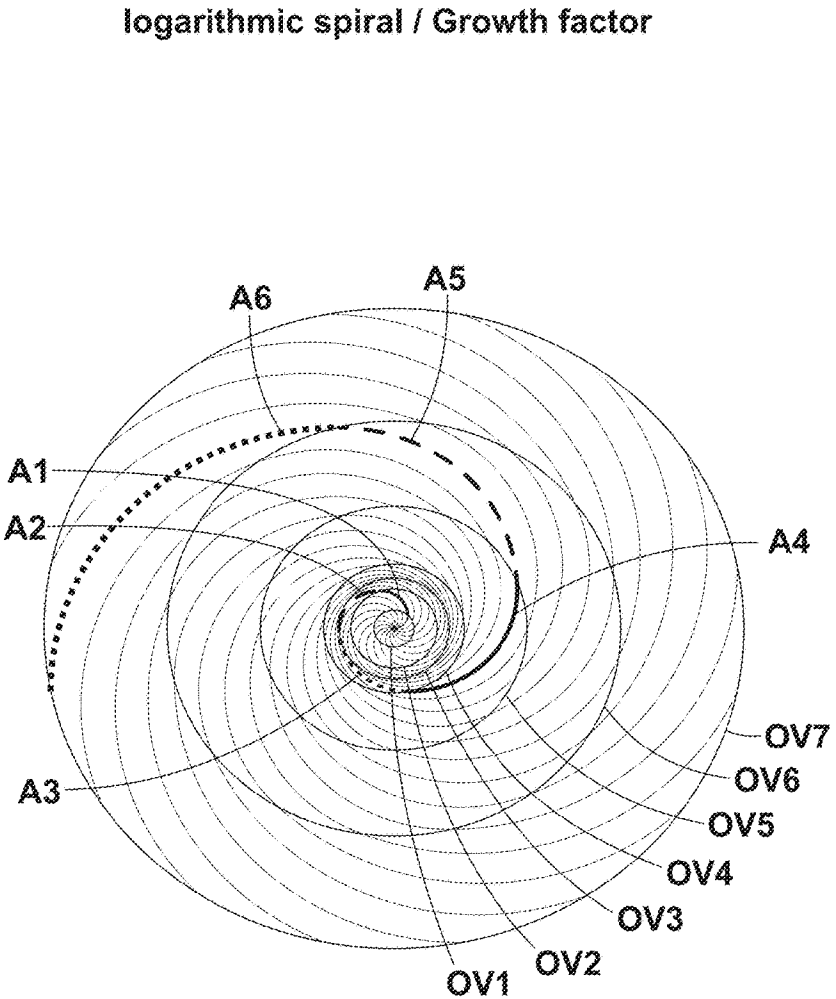
FIG. 5A is a top plan view of a second example of a first set of logarithmic (normal) spiral pathways (A) showing a spiral pathway containing different spiral pathway segments, wherein the length of the spiral segments increases by a growth factor.

In FIGS. 5A-5C, another example of a spiral pathway containing multiple spiral pathway segments (A1, A2, A3, A4, A5, and A6) with a different growth factor is shown. In this example, the length of the spiral segment A1 is 0.29 inches; and the length of spiral segment A2 is 0.45 inches; and the length of spiral segment A3 is 0.75 inches, with a growth factor is 1.61. This growth factor of the different segments stays the same as the spiral pathway grows and extends outwardly as shown in Table 3 of FIG. 5B. That is, the growth factor stays consistent (in this example, the growth factor is 1.61) throughout the spiral pathway. This growth factor can be expressed in a geometrical equation as shown in Table 4 of FIG. 5C. Thus, the growth of the spiral pathways is organic and clean and can be expressed in mathematical equations as shown in the examples of FIGS. 4A-4C and FIGS. 5A-5C. The spiral pathways provide the outsole of the shoe with a natural and organic look.

Figures 6A, 6B, 6C, 6D:
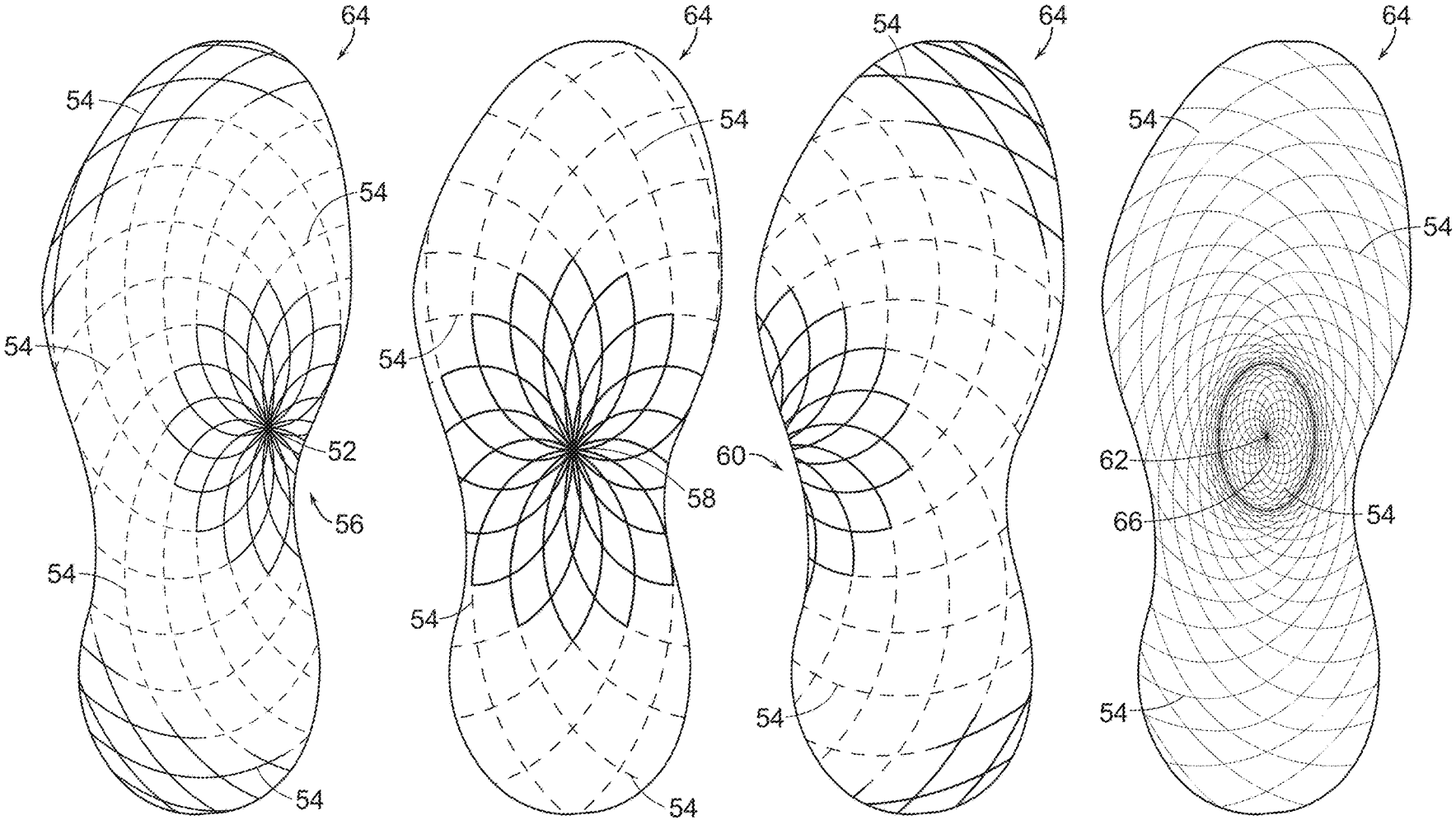
FIG. 6A is a bottom plan view of one example of an outsole of the present invention showing the point of origin of the spiral pathways in the arch area of the outsole.
FIG. 6B is a bottom plan view of one example of an outsole of the present invention showing the point of origin of the spiral pathways in the central mid-foot region of the outsole.
FIG. 6C is a bottom plan view of one example of an outsole of the present invention showing the point of origin of the spiral pathways outside the lateral mid-foot region of the outsole.
FIG. 6D is a bottom plan view of one example of an outsole of the present invention showing the point of origin of the spiral pathways in the central mid-foot region of the outsole, wherein the spiral pathways are on a smaller scale than the spiral pathways shown in FIGS. 6A-6C.

It should be understood that the point of origin of the spiral pathways can be at various locations. Referring to FIGS. 6A-6D, an outsole of a right shoe (64) is shown containing the spiral pathways superposed over each other as discussed above. In FIG. 6A, the point of origin (52) of the spiral pathways (54) is shown in the arch area (56) of the outsole. In FIG. 6B, the point of origin (58) of the spiral pathways (54) is shown in the central mid-foot region of the outsole. In FIG. 6C, the point of origin of the spiral pathways (54) is outside the lateral edge (60) of the mid-foot region of the outsole; and in FIG. 6D, the point of origin (62) is shown in the central mid-foot region of the outsole, wherein the lengths of the spiral segments and spiral pathways are miniaturized (66). The spiral segments and spiral pathways shown in FIG. 6D are on a much smaller scale than the spiral segments and spiral pathways shown in FIGS. 6A-6C.

Figure 7:
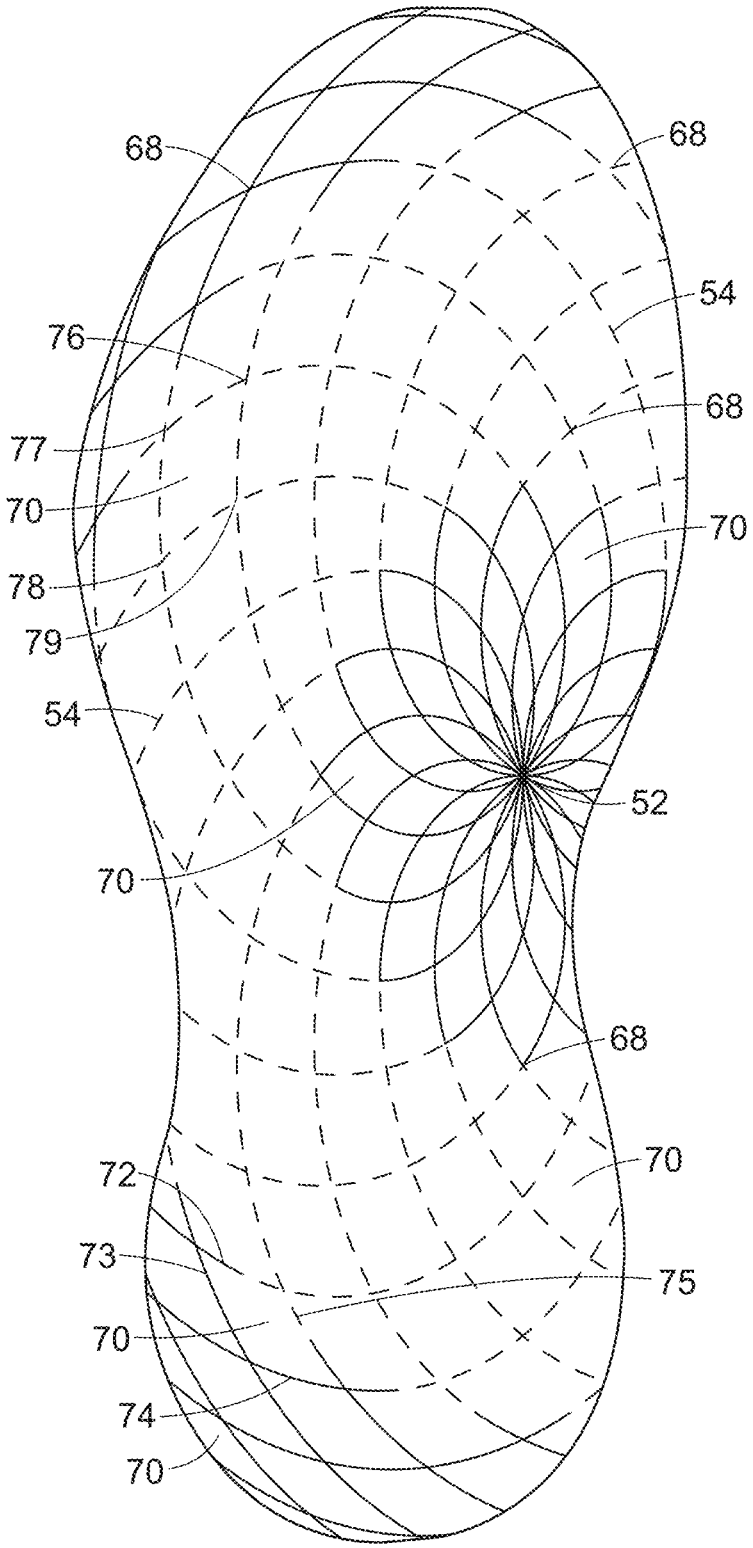
FIG. 7 is a close-up view of the outsole shown in FIG. 6A, where the focal point of the spiral pathways is on the medial side and in the arch area of the outsole.

Referring to FIG. 7, the outsole of FIG. 6A, where the focal point (52) of the spiral pathways (54) is on the medial side and in the arch area of the outsole is shown in more detail. Here, the intersecting points (68) between the different arc pathways (54) and the generation of the four-side tile pieces (70) is shown in more detail. The curved sub-segments (72, 73, 74, and 75) of a spiral segment are pieced together to create substantially four-sided tile pieces (70) on the outsole of the shoe. The intersecting points between the superposed sets of spiral pathways (A) and (B) form the corners of these tile pieces (for example, the corners can be seen as 76, 77, 78, and 79.) These individual tile pieces (70) contain different traction members (not shown in FIG. 7) as discussed further below.

As described above, in one example, the outsole comprises a first set of arc pathways having a center point located on the medial side of the forefoot region and extending along the forefoot region in a generally longitudinal direction. The radius of each arc pathways increases from the center point as the arcs extend along the forefoot region. A second set of arc pathways have a center point located on the posterior end of the forefoot region and extend along the forefoot region in a generally transverse direction. The radius of each arc pathway increases from the center point as the arcs extend along the forefoot region.

When the first and second arc pathways are superposed over each other, four-sided tile pieces are formed on the surface of the forefoot region. In one embodiment, the first and second arc pathways with their varying radii and their intersection points can be limited to the forefoot region. That is, in one embodiment, only the forefoot region may contain the four-sided tile pieces with the projecting traction members. The other regions (for example, the mid-foot and rear-foot regions) may contain no traction members or different configurations of traction members. In other embodiments, as discussed above, the entire outsole may contain the arc pathways, intersecting points, and resulting four-sided tiles. In still other embodiments, select regions of the outsole other than the forefoot region may contain the arc pathways, intersecting points, and tile pieces.

For example, the outsole may comprise a first set of arc pathways having a center point located on the medial side of the rear-foot region and extending along the rear-foot region in a generally longitudinal direction. The radius of each arc pathways increases from the center point as the arcs extend along the rear-foot region. A second set of arc pathways have a center point located on the posterior end of the rear-foot region and extend along the rear-foot region in a generally transverse direction. The radius of each arc pathway increases from the center point as the arcs extend along the rear-foot region. When the first and second arc pathways are superposed over each other, intersecting points between the first and second set of arc pathways are formed. The intersecting points form four-sided tile pieces on the surface of the rear-foot region.

In general, the anatomy of the foot can be divided into three bony regions. The rear-foot region generally includes the ankle (talus) and heel (calcaneus) bones. The mid-foot region includes the cuboid, cuneiform, and navicular bones that form the longitudinal arch of the foot. The forefoot region includes the metatarsals and the toes. Referring back to FIG. 1, the outsole (16) has a top surface (not shown) and bottom surface (27). The midsole (14) is joined to the top surface of the outsole (16). The upper (12) is joined to the midsole (14).

Figure 8:
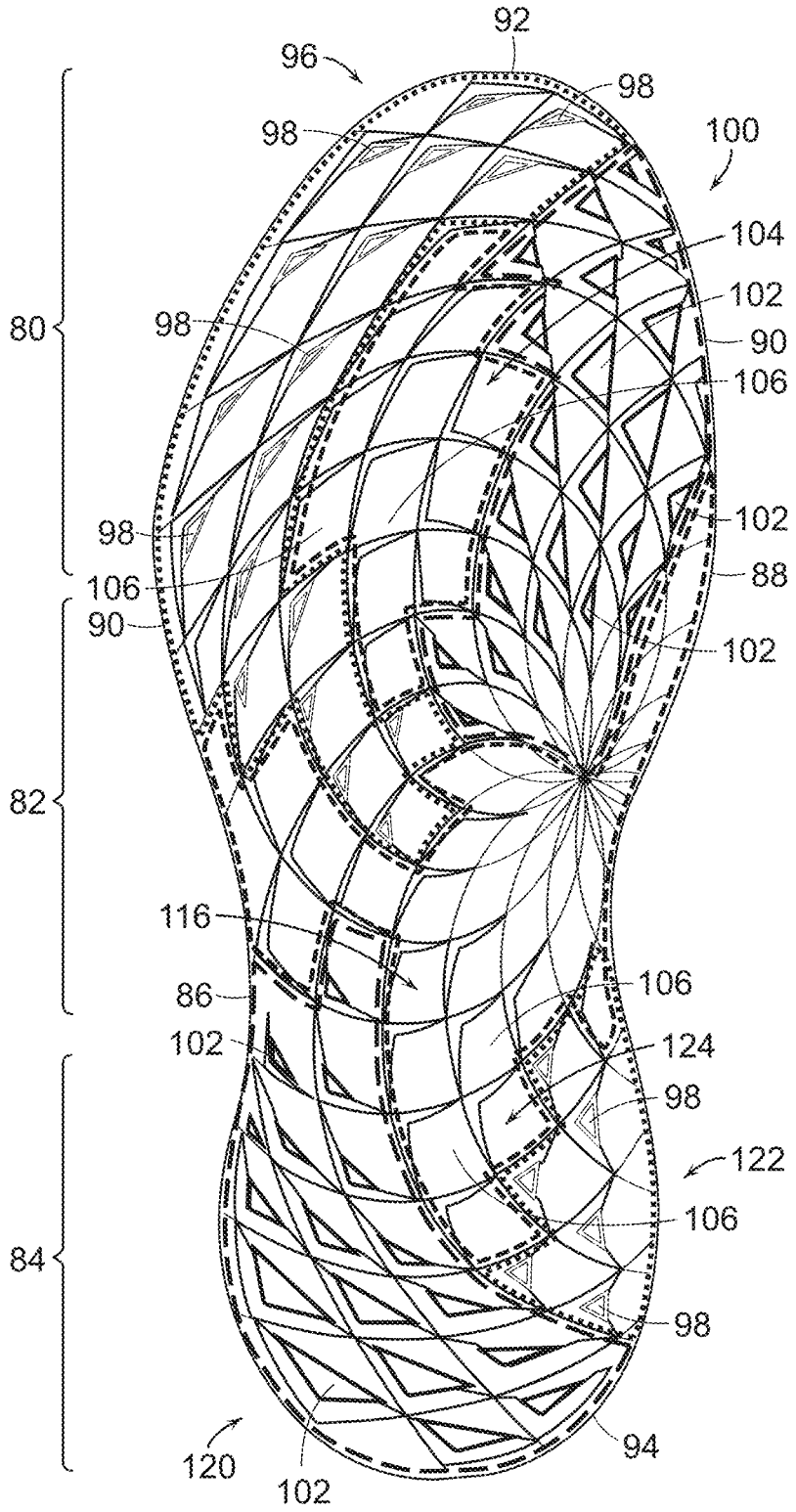
FIG. 8 is a bottom plan view of one example of an outsole of the present invention showing tiles containing different traction members, wherein the tiles are arranged in different zones on the outsole.

Turning to FIG. 8, the outsole (16) generally includes a forefoot region (80) for supporting the forefoot area; a mid-foot region (82) for supporting the mid-foot including the arch area; and rearward region (84) for supporting the rear-foot including heel area. In general, the forefoot region (80) includes portions of the outsole corresponding with the toes and the joints connecting the metatarsals with the phalanges. The mid-foot region (82) generally includes portions of the outsole corresponding with the arch area of the foot. The rear-foot region (84) generally includes portions of the outsole corresponding with rear portions of the foot, including the calcaneus bone.

The outsole also includes a lateral side (86) and a medial side (88). Lateral side (86) and medial side (88) extend through each of the foot regions (80, 82, and 84) and correspond with opposite sides of the outsole. The lateral side or edge (86) of the outsole is the side that corresponds with the outer area of the foot of the wearer. The lateral edge (86) is the side of the foot of the wearer that is generally farthest from the other foot of the wearer (that is, it is the side closer to the fifth toe [little toe].) The medial side or edge (88) of the outsole is the side that corresponds with the inside area of the foot of the wearer. The medial edge (88) is the side of the foot of the wearer that is generally closest to the other foot of the wearer (that is, the side closer to the hallux [big toe].)

More particularly, the lateral and medial sides extend around the periphery or perimeter (90) of the outsole (16) from the anterior end (92) to the posterior end (94) of the outsole. The anterior end (92) is the portion of the outsole corresponding to the toe area, and the posterior end (94) is the portion corresponding to the heel area. Measuring from the lateral or medial edge of the outsole in a linear direction towards the center area of the outsole, the peripheral area generally has a width of about 3 to about 6 mm. The width of the periphery may vary along the contour of the outsole and change from the forefoot to mid-foot to rear-foot regions (80, 82, and 84).

The regions, sides, and areas of the outsole as described above are not intended to demarcate precise areas of the outsole. Rather, these regions, sides, and areas are intended to represent general areas of the outsole. The upper (12) and midsole (14) also have such regions, sides, and areas. Each region, side, and area also may include anterior and posterior sections.

Forefoot Region

As further shown in FIG. 8, the forefoot region (80) of the outsole includes a first (lateral) zone of tiles (96) containing protruding traction members (98) extending along the periphery of the forefoot region; a third (medial) zone of tiles (100) containing protruding traction members (102) extending along the opposing periphery of the forefoot region; and a second (middle) zone of tiles (104) containing protruding traction members (106) disposed between the first and third zones.

Figure 9A:
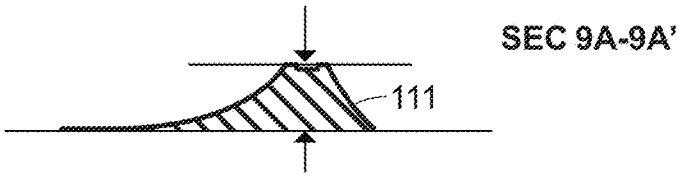
FIG. 9A is a cross-sectional view of the traction member in FIG. 9 along Line A-A'.
Figure 9:
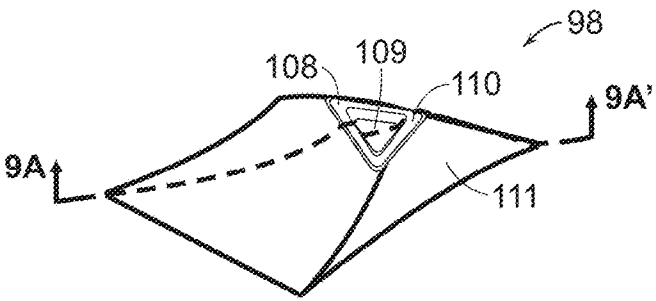
FIG. 9 is a perspective view of one example of a traction member shown in the outsole of FIG. 8.

Referring to FIGS. 8, 9, and 9A, the traction members (98) in the first (lateral) zone of tiles (96) have sloping sides with a triangular-shaped top surface (108) containing recessed (109) and non-recessed areas (110), the non-recessed areas (110) forming a ground contacting surface, and wherein the total ground contact surface area is in the range of about 10 to about 35% based on total surface area of the tile (70). In one preferred embodiment, the total ground contact surface area is in the range of about 17 to about 28%. These traction members (98) are primarily used for golf-specific traction, that is, these traction members help control forefoot lateral traction, and prevent the foot from slipping during a golf shot.

For example, during normal golf play, a golfer makes shots with a wide variety of clubs. As the golfer swings a club when making a shot and transfers their weight, the foot absorbs tremendous forces. In many cases, when a right-handed golfer is addressing the ball, their right and left feet are in a neutral position. As the golfer makes their backswing, the right foot presses down on the medial forefoot and heel regions, and, as the right knee remains tucked in, the right foot creates torque with the ground to resist external foot rotation. Following through on a shot, the golfer's left shoe rolls from the medial side (inside) of their left foot toward the lateral side (outside) of the left foot. Meanwhile, their right shoe simultaneously flexes to the forefoot and internally rotates as the heel lifts. As discussed above, significant pressure is applied to the exterior of the foot at various stages in the golf shot cycle. In the present invention, the first zone of the outsole is designed to provide support and stability to the sides of the foot. That is, the first zone provides support around the lateral edges of the outsole. This first zone helps hold and support the lateral side of the golfer's foot as he/she shifts their weight when making a shot. The shoe provides good traction and control of lateral movement. Thus, the golfer has better stability and balance in all phases of the game.

Figure 10A:
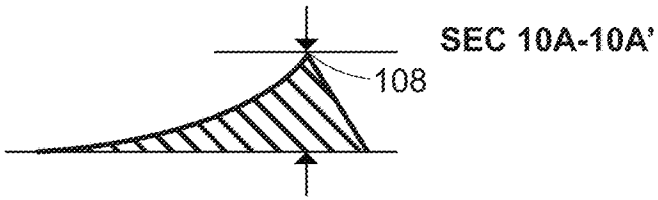
FIG. 10A is a cross-sectional view of the traction member in FIG. 10 along Line A-A'.
Figure 10:
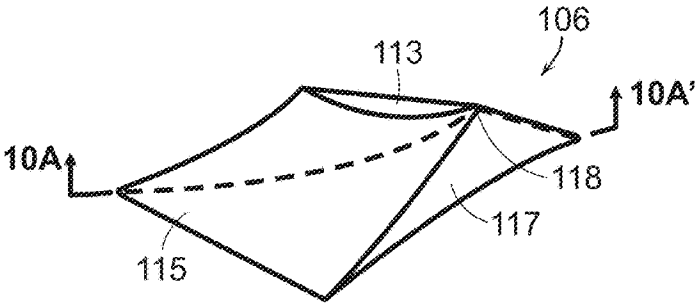
FIG. 10 is a perspective view of a second example of a traction member shown in the outsole of FIG. 8.

Next, referring to FIGS. 8, 10, and 10A, the traction members (106) in the second (middle) zone of tiles (104) have a three-sided pyramid-like shape with three sloping surfaces (113, 115, 117) extending from a pyramid-like base and an apex (118), and wherein the total ground contact surface area is in the range of about 5 to about 40% based on total surface area of the tile (70). In one preferred embodiment, the total ground contact surface area is in the range of about 12 to about 33%. Only one edge, that is, the apex (118) of the traction member (106) is in contact with the ground so the gripping power per volume of tile (70) is maximized. These traction members (106) provide comfort and tend to distribute pressure from the middle (second) zone out to the periphery of the sole, that is, to the lateral (first) and medial (third) zones. These traction members (106) in the middle zone are relatively softer and more compliant than the traction members in the neighboring lateral and medial zones. Thus, the middle zone acts as a comfort zone relieving the pressure placed on the center of the outsole and pushing it to the lateral and medial sides of the outsole. Also, if sufficient shoe pressure is applied and the traction members (106) in the middle zone are compressed and flattened to a certain degree, they will make relatively good contact with the ground and provide some grip.

Figure 11A:
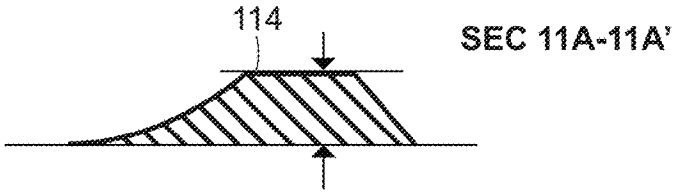
FIG. 11A is a cross-sectional view of the traction member in FIG. 11 along Line A-A'.
Figure 11:
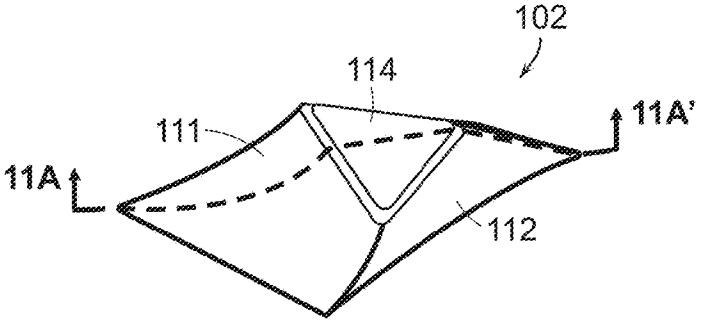
FIG. 11 is a perspective view of a third example of a traction member shown in the outsole of FIG. 8.

Lastly, referring to FIGS. 8, 11, and 11A, the traction members (102) in the third (medial) zone of tiles (100) have two sloping surfaces (111, 112) with a triangular-shaped, non-recessed top surface (114) that forms a ground contacting surface, and wherein the total ground contact surface area is in the range of about 20 to about 60% based on total surface area of the tile (70). In one preferred embodiment, the total ground contact surface area is in the range of about 27 to about 53%. These traction members (102) provide a high contact surface area to prevent slipping on hard, wet, and smooth surfaces. Maximum contact by the traction members (102) is maintained in this third zone (100). The traction members (102) also help to push water away from the shoe as a person follows their normal walking gait cycle as described in further detail below.

Typically, when a person starts naturally walking, the outer part of his/her heel strikes the ground first with the foot in a slightly supinated position. As the person transfers his/her weight to the forefoot, the arch of the foot is flattened, and the foot is pressed downwardly. The foot also starts to rolls slightly inwardly to a pronated position. In some instances, the foot may roll inwardly to an excessive degree and this is type of gait is referred to as overpronation. In other instances, the foot does not roll inwardly to a sufficient degree and this is referred to as underpronation. Normal foot pressure is applied downwardly and the foot starts to move to a normal pronated position and this helps with shock absorption. After the foot has reached this neutral (mid-stance) position, the person pushes off on the ball of his/her foot and continues walking. At this point, the foot also rolls slightly outwardly again. The above-described traction members in the third (medial) zone of tiles are particularly effective in providing maximum contact with the ground to help prevent a person from slipping and losing their balance when walking.

Mid-Foot Region

As also shown in FIG. 8, the mid-foot region (82) of the outsole further comprises a zone of tiles (116) containing protruding traction members (106) extending along the mid-foot region, and wherein the traction members have a three-sided pyramid-like shape with three sloping surfaces (113, 115, 117) extending from a pyramid-like base and an apex (118) (See FIGS. 10 and 10A), and wherein the total ground contact surface area is in the range of about 5 to about 40% based on total surface area of the tile (70). Thus, the traction members (106) in the mid-foot region zone of tiles (116) are similar to the traction members (106) found in the second (middle) zone of tiles (104) located in the forefoot region (80). In one preferred embodiment, the total ground contact surface area is in the range of about 12 to about 33%. As discussed above, these traction members (106) provide comfort and tend to distribute pressure from the central area of the mid-foot region toward the peripheral edges of the outsole.

Rear-Foot Region

Turning to the rear-foot region (84) and FIG. 8, the traction members found in this region (84) are similar to the traction members found in the forefoot region (80). However, the zones in the rear-foot region (84) are reversed from the zones in the forefoot region (80). Thus, as shown in FIG. 8, there is a first (lateral) zone of tiles (120) containing protruding traction members (102) extending along the periphery of the rear-foot region (84); a third (medial) zone of tiles (122) containing protruding traction members (98) extending along the opposing periphery (medial side) of the rear-foot region (84); and a second (middle) zone of tiles (124) containing protruding traction members (106) disposed between the rear-foot first (120) and third (122) zones.

First, the traction members (102) in the rear-foot first (lateral) zone of tiles (120) have sloping sides (111, 112) with a triangular-shaped, non-recessed top surface (114) that forms a ground contacting surface, and wherein the total ground contact surface area is in the range of about 20 to about 60% based on total surface area of the tile (70). (See FIGS. 11 and 11A.) Thus, the traction members (102) in the rear-foot first (lateral) zone of tiles (120) are similar to the traction members (102) found in the third (medial) zone of tiles (100) located in the forefoot region (80). As discussed above, these traction members (102) provide a high contact surface area to prevent slipping on hard, wet, and smooth surfaces. Further, the horizontal-facing sidewalls of the traction members help prevent the golfer from slipping when he/she is walking downwardly on golf course slopes. Maximum contact by the traction members (102) is maintained in this rear-foot first (lateral) zone of tiles (120) and the forefoot third (medial) zone of tiles (100).

Meanwhile, as also shown in FIG. 8, the traction members (106) in the rear-foot second (middle) zone of tiles (124) have a three-sided pyramid-like shape with three sloping surfaces (113, 115, 117) extending from a pyramid-like base and an apex (118) (See FIGS. 10 and 10A), and wherein the total ground contact surface area is in the range of about 5 to about 40% based on total surface area of the tile (70). Thus, the traction members (106) in the rear-foot second (middle) zone of tiles (124) are similar to the traction members (106) found in the second (middle) zone of tiles (104) located in the forefoot region (80). As discussed above, these traction members (106) provide comfort and tend to distribute pressure from the middle zone in the rear-foot region out to the periphery of the sole.

Finally, in FIG. 8, the traction members (98) in the rear-foot third (medial) zone of tiles (122) have a triangular-shaped top surface (108) containing recessed (109) and non-recessed (110) areas, the non-recessed areas forming a ground contacting surface (See FIGS. 9 and 9A), and wherein the total ground contact surface area is in the range of about 10 to about 35% based on total surface area of the tile (70). As discussed above, these traction members (98) are primarily used for golf-specific traction, that is, these traction members help control forefoot and rear-foot lateral traction, and prevent the foot from slipping while playing.

Figure 12:
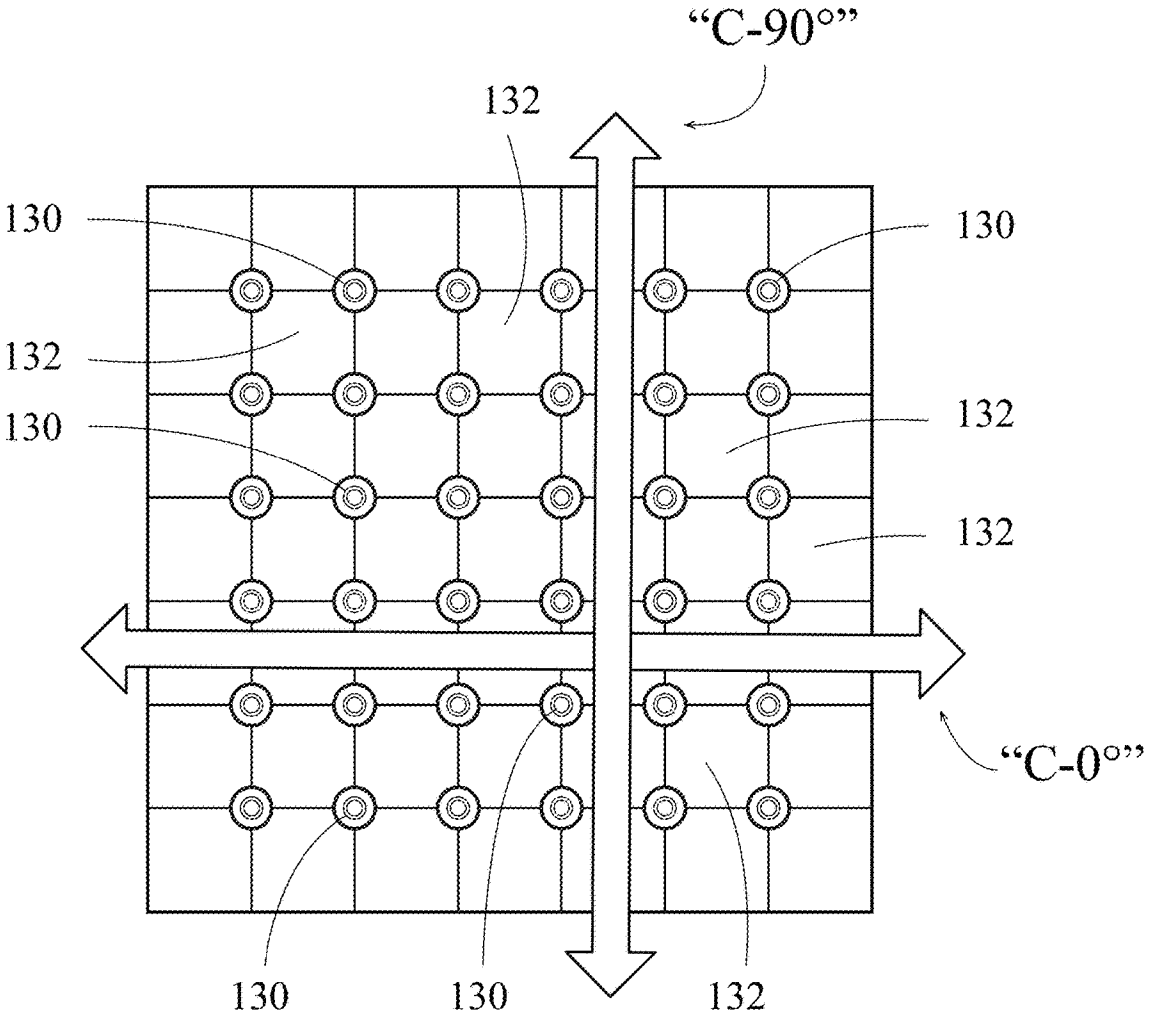
(PRIOR ART) FIG. 12
FIG. 12 is a bottom plan view of an outsole of the prior art, wherein the traction members are arranged in a linear configuration with channels and showing that a turf-trenching effect occurs in the 90 degree and 0 degree directions.
Figure 13:
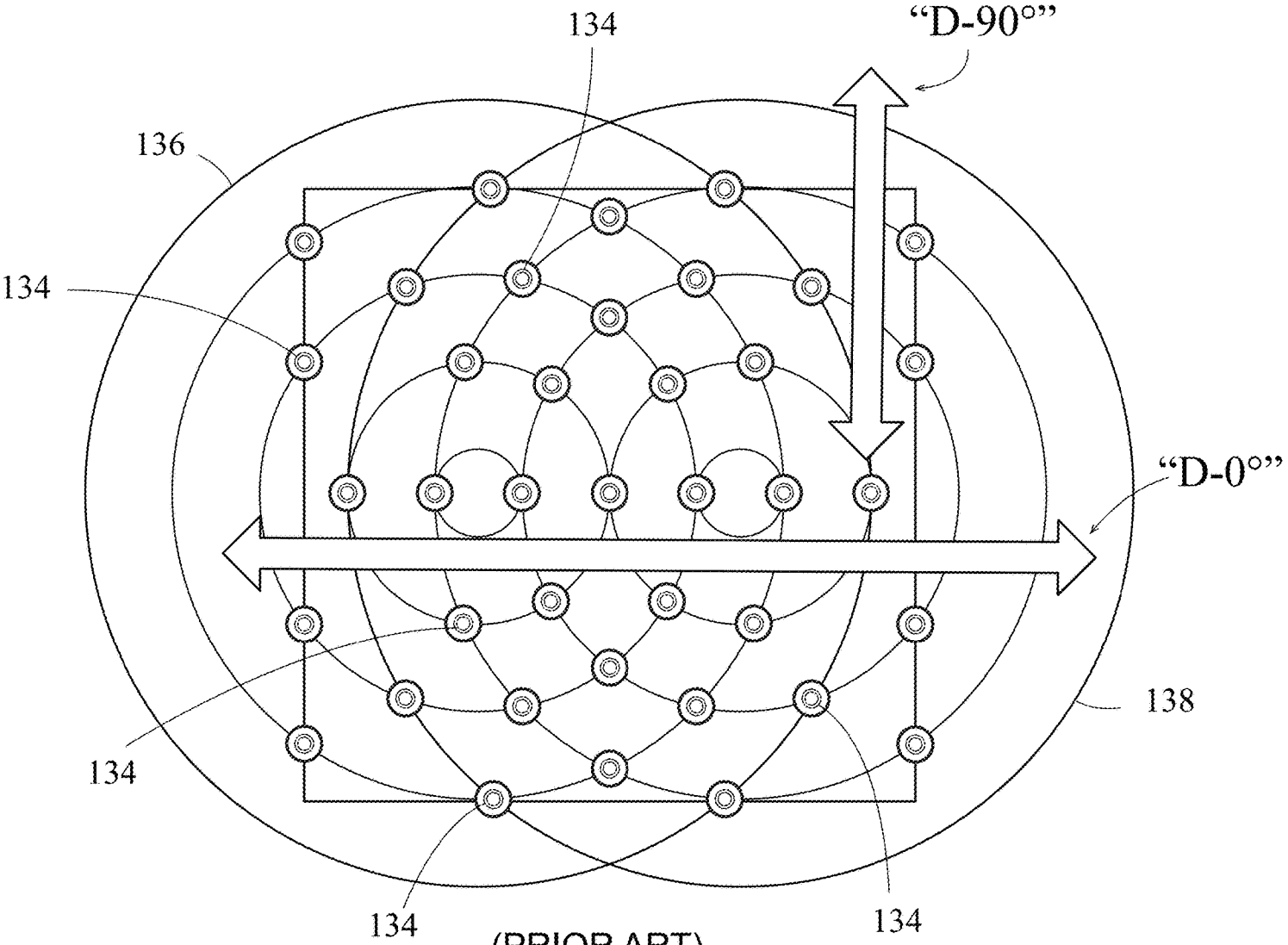
(PRIOR ART) FIG. 13
FIG. 13 is a bottom plan view of an outsole of the prior art, wherein the traction members are arranged in a double-radial configuration with channels, and showing that a turf-trenching effect occurs in the 90 degree and 0 degree directions.
Figure 14:
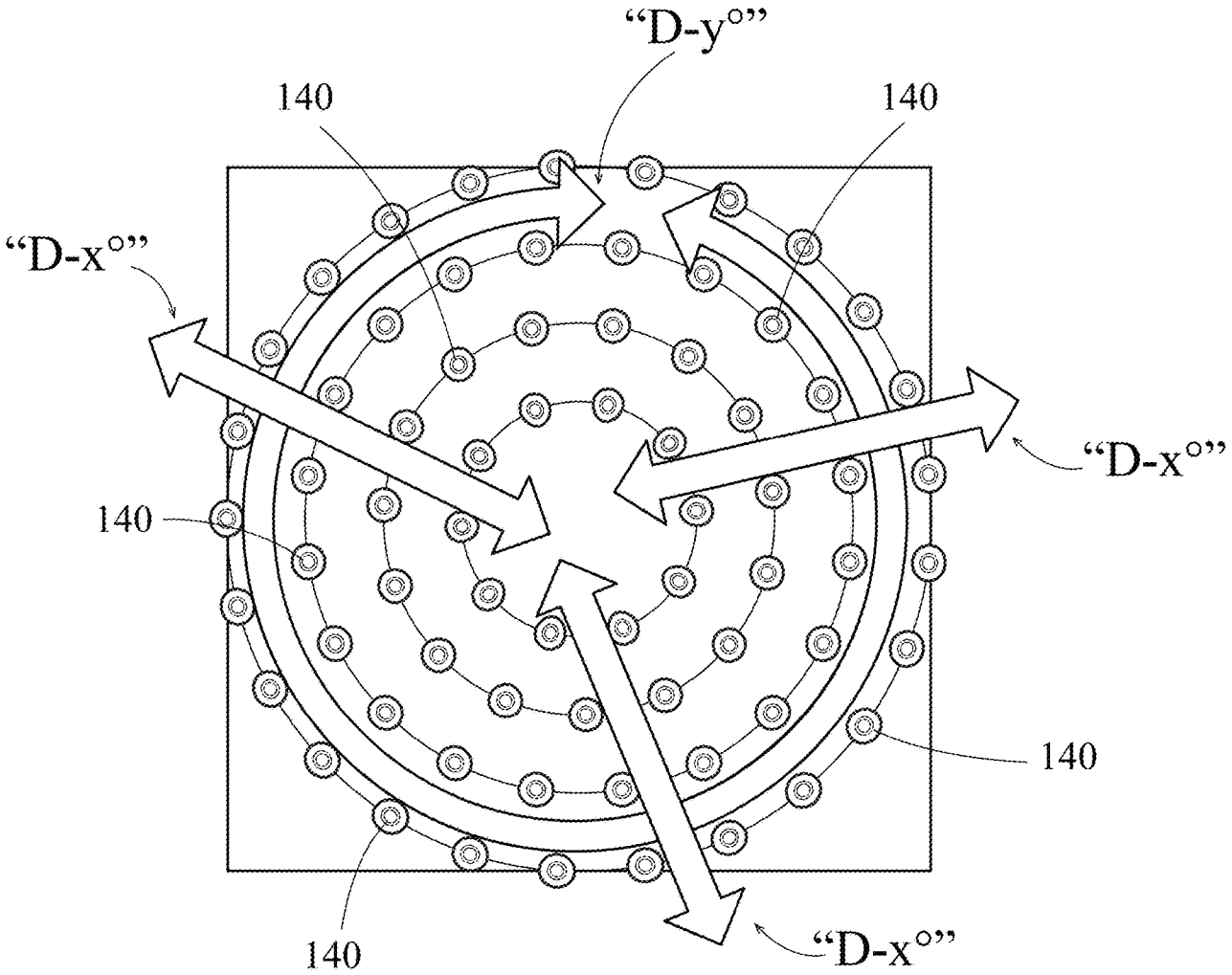
(PRIOR ART) FIG. 14
FIG. 14 is a bottom plan view of an outsole of the prior art, wherein the traction members are arranged in a circular configuration with channels; and showing that a turf-trenching effect occurs in various directions including a rotational direction.
Figure 15:
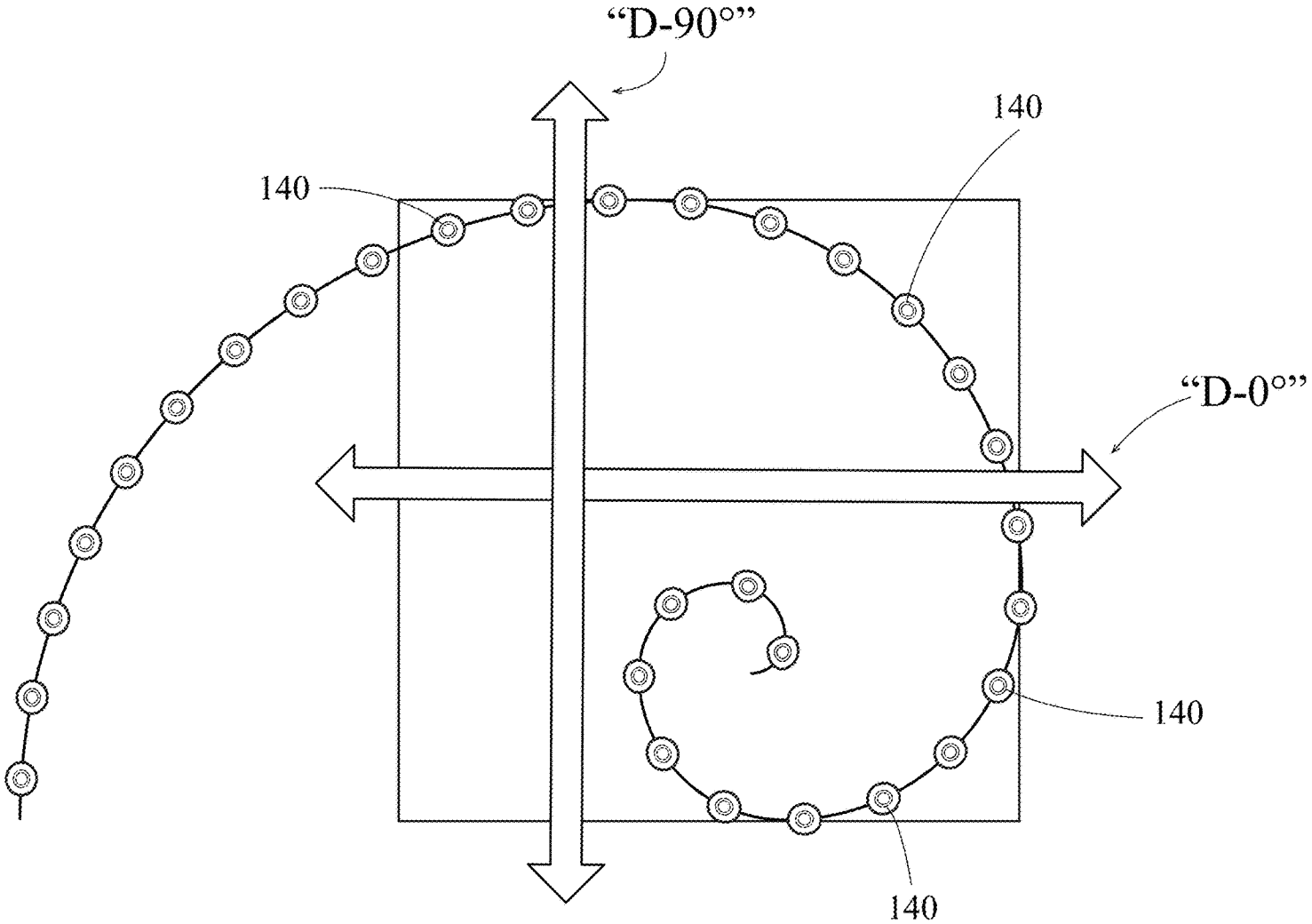
(PRIOR ART) FIG. 15
FIG. 15 is a bottom plan view of an outsole of the prior art, wherein the traction members are arranged in a single logarithmic spiral configuration with channels; and showing that a turf-trenching effect occurs in the 90 degree and 0 degree directions.

The above-described traction zones in the shoe outsoles of this invention help provide improved traction on all surfaces. Furthermore, these shoes are optimally suited for use on the golf course, because they reduce turf-trenching per the amount of traction provided. The shoes of this invention help prevent damage to the course turf, particularly to putting greens. In contrast, many prior art golf shoes contain traction members arranged in a linear or double-radial configuration. These traditional channeled outsole structures provide less traction per total traction member penetration area; and this can result in more turf damage per amount of traction. In addition, these conventional shoe outsoles may not have good traction on all surfaces. Such channeled outsoles can provide less than optimum traction for the damage that they create on the course. As shown in FIG. 12, this turf-trenching effect for prior art outsoles containing traction members (130) and channels (132) in a linear configuration (transverse rows along a longitudinal length of the outsole) occurs substantially in both the 90 degree (Arrow C-90°) and 0 degree (Arrow C-0°) directions. Next, as shown in FIG. 13, with traction members (134) arranged in overlapping circular patterns (136, 138) (double-radial configuration) on prior art outsoles, there can be low turf-trenching in the 90 degree directions (Arrow D-90°), but there is substantial turf-trenching in the 0 degree directions (Arrow D-0°). Turning to FIG. 14, with traction members (140) arranged in a concentric circular pattern, there are still channels in this geometric configuration, and there can be trenching in various directions. For example, there can be trenching in linear directions (Arrows D-x°); and rotational directions (Arrows D-y°). Thus, as shown in FIG. 14, trenching can occur in both linear and arcing patterns. In yet another example of a prior art outsole, as shown in FIG. 15, traction members (140) can be arranged in a single logarithmic spiral and channels are still created. With this geometric configuration, trenching occurs substantially in both the 90 degree (Arrow D-90°) and 0 degree (Arrow D-0°) directions.

More particularly, as shown in FIG. 12, when the traction members (130) are arranged in a co-linear pattern and there is close proximity between the members, this tends to cause turf-trenching. Secondly, the outsole structure in FIG. 12 contains linear channels (132), where no traction members are located, and these channeled areas provide no traction. Turf-trenching causes concentrated damage to the turf, while poor traction causes no damage to the turf. But, turf-trenching and traction properties are related. If the shoe slips enough so that one traction member reaches the position of the neighboring traction member, then traction will drop-off due to the traction members pushing through weakened or damaged turf. This slipping of multiple traction members through the same turf causes turf-trenching. Meanwhile, the linear channels do not provide any traction. Since these linear channels do not contain any traction members, the outsole (for example, rubber material) directly contacts the ground surface and there is no gripping strength.

Figure 16:
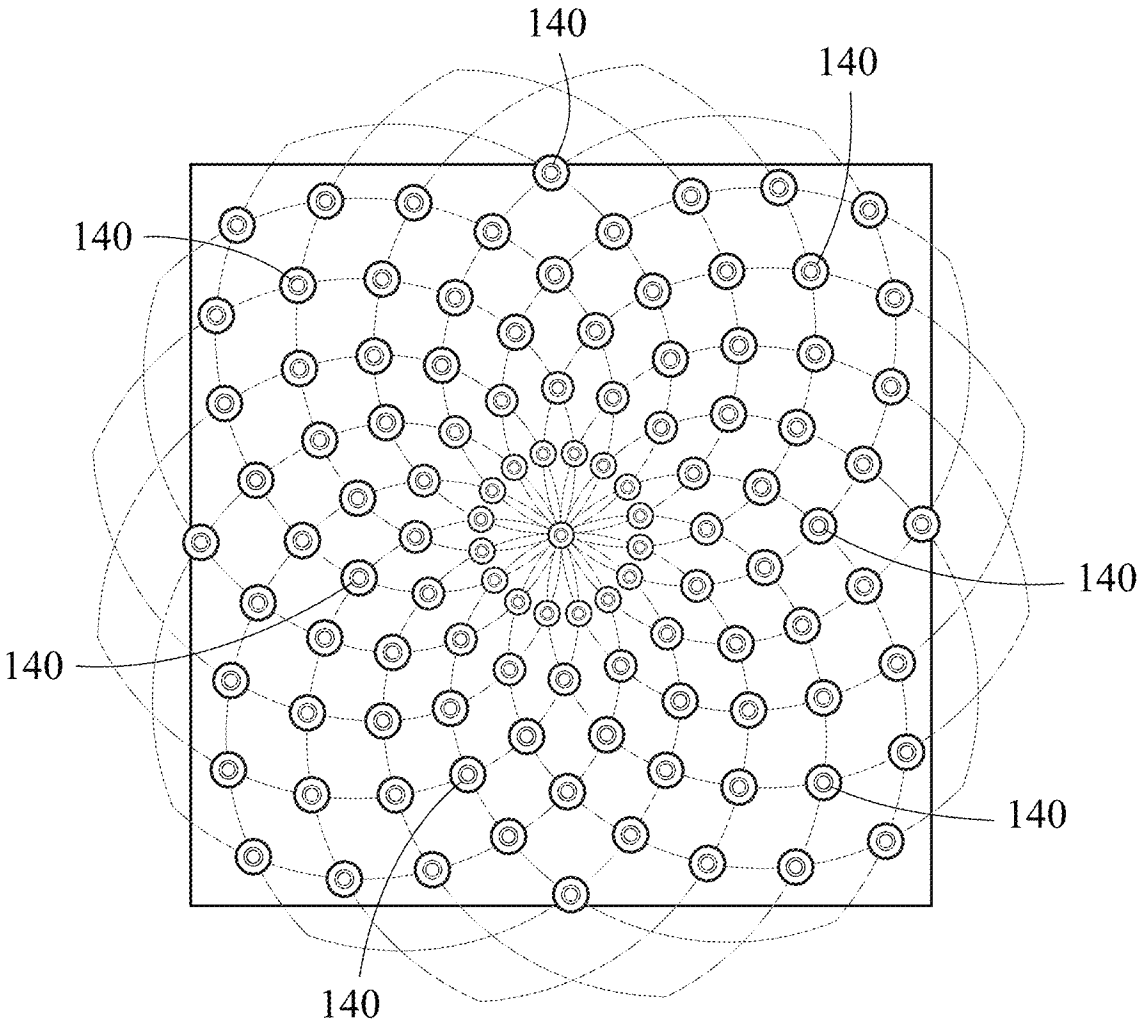
FIG. 16 is a bottom plan view of one example of an outsole of the present invention, wherein the traction members are arranged in different arc pathways with no channeling, and showing that there is no turf-trenching effect.

In the present invention, as shown in FIG. 16 and discussed above, the traction members (140) of the outsole are arranged in an eccentric configuration and each adjacent traction member is positioned at a different radius from a given center of rotation. This results in improved traction for the shoe on all surfaces—there is no channeling and little or no trenching of the turf for the amount of traction provided. The shoe outsoles of this invention do not have a linear channel configuration with closely spaced-apart traction members that can cause turf-trenching. Rather, the shoe outsoles of this invention have traction members that provide optimal traction given the number of traction members in the outsole. That is, these outsoles impart less damage to the golf course for a given amount of traction.

Another advantage of the shoe of this invention is it can be worn when engaging in activities off the golf course. For example, the shoes can be worn as a casual, "off-course" shoe in the clubhouse, office, home, and other ordinary places. On all flooring and other surfaces, the outsole construction has a high traction per volume of traction members for the amount of traction provided. Furthermore, the shoe is lightweight and comfortable so it can be worn easily while walking and in other activities. For example, the shoe can be worn while playing recreational sports such as tennis, squash, racquetball, street hockey, softball, soccer, football, rugby, and sailing. Thus, shoe can be worn when engaging in many different activities on many different surfaces. The shoe provides unique traction and gripping strength on both firm and soft surfaces.

It should be understood that the above-described outsole which generally includes: a) a forefoot region containing first, second (middle), and third zone of tiles with traction members; b) a mid-foot region containing a zone of tiles with traction members; and c) a rear-foot region containing first, second (middle), and third zone of tiles with traction members represents only one example of an outsole structure that can be used in the shoe construction of this invention. As discussed above, the unique pattern of the traction members in the lateral, medial, and middle zones provides improved traction on both hard and soft surfaces. This geometric configuration of traction members helps provide a shoe with high traction per volume of traction members and minimal turf-trenching properties for the amount of traction provided. However, it is recognized that other patterns of traction members can be used without departing from the spirit and scope of this invention.

Furthermore, the traction members disposed on the outsole can have different shapes than the shapes described above to provide optimal traction given the number of traction members. That is, the outsoles can contain a wide variety of traction members so that the gripping power for a particular surface is maximized and less damage is done to that surface for the amount of traction provided. The traction members can have many different shapes including for example, but not limited to, annular, rectangular, triangular, square, spherical, elliptical, star, diamond, pyramid, arrow, conical, blade-like, and rod shapes. Also, the height and area of the traction members and volume of traction member per given tile on the outsole can be adjusted as needed. As discussed above, these different-shaped traction members are arranged on the outsole in a non-channeled pattern. The different traction members and their distinct pattern on the outsole, with no channeling, help provide a shoe with high traction and low turf-trenching properties.

Figure 17B:
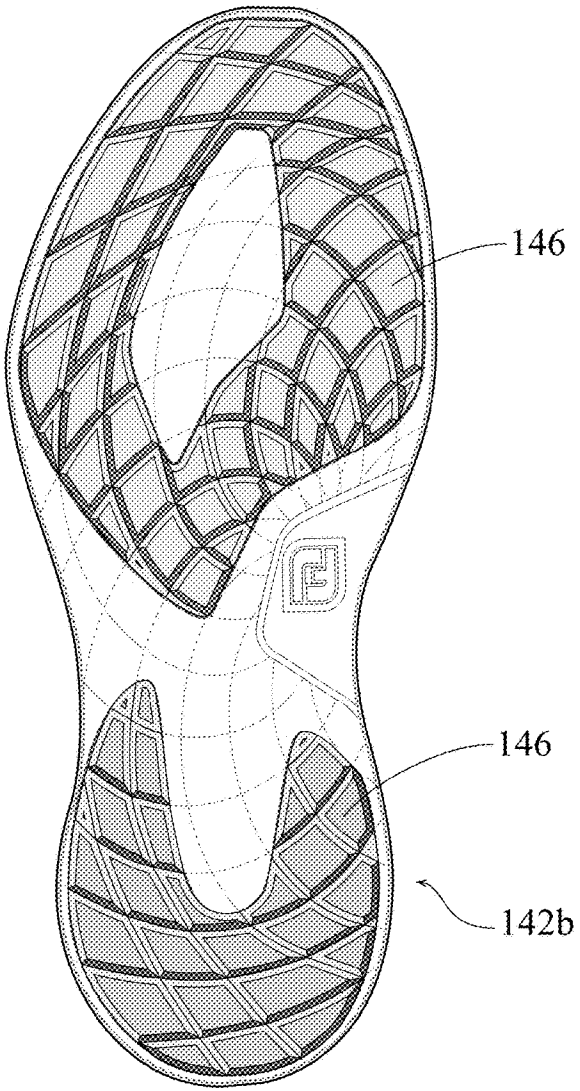
FIG. 17B is a bottom plan view of a third example of an outsole of the present invention, containing different types of traction members than the members found in the outsole of FIGS. 16 and 17A, but wherein the members are arranged in a similar configuration with no channeling, and no turf-trenching effect.
Figure 17A:
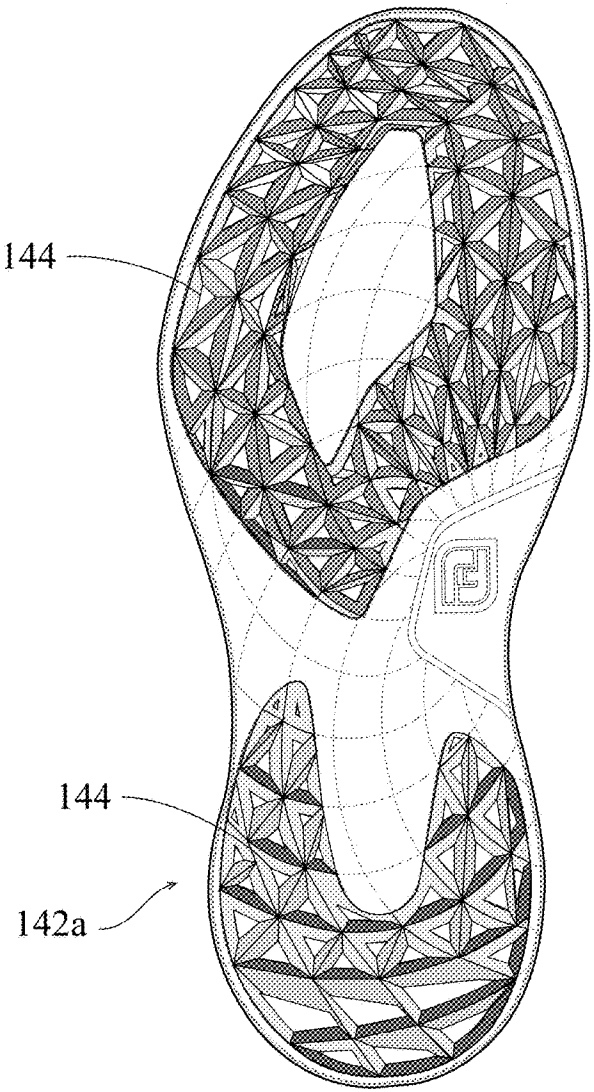
FIG. 17A is a bottom plan view of a second example of an outsole of the present invention, containing different types of traction members than the members found in the outsole of FIG. 16, but wherein the members are arranged in a similar configuration with no channeling, and no turf-trenching effect.

For example, referring to FIGS. 17*a* and 17*b*, two outsole constructions (142*a*, 142*b*) having different sets of traction members are shown. In FIG. 17*a*, the outsole construction (142*a*) has a set of traction members (144) designed particularly for providing good traction on soft surfaces such as a soccer pitch, and lacrosse, rugby, and football fields, and the like. These traction members (144) have specific shapes and dimensions for providing a high level of stability and traction on the course. This outsole construction helps hold and support the medial and lateral sides of the golfer's foot as he/she shifts their weight when making a golf shot. This shoe outsole (142*a*) provides good traction so there is no slipping and the golfer can stay balanced.

Turning to FIG. 17*b*, the outsole construction (142*b*) has a set of traction members (146) designed particularly for providing high traction on firm and particularly smooth and even more particularly hard, wet, and smooth surfaces such as boat decks, polished concrete and marble flooring in sidewalks, painted surfaces of sidewalks, and the like. These traction members (146) have specific shapes and dimensions for providing good gripping strength and traction on a variety of surfaces. For example, the shoes can be worn while walking and in the clubhouse, office, and at home, or in various recreational activities as described above. The traction members (146) maintain high contact with the surface and provide stability. The traction members (146) help prevent slipping on hard, wet, and smooth surfaces.

It should be understood that the outsoles (142*a*, 142*b*) can have different traction members (144, 146), as shown in FIGS. 17*a* and 17*b*, to optimize the outsole for either on-course or off-course wear, that is, for both firm and soft surfaces. However, in both outsole constructions (142*a*,

142*b*), the outsoles generally have a tread pattern as described above: a) a forefoot region containing first, second (middle), and third zone of tiles with traction members; b) a mid-foot region containing a zone of tiles with traction members; and c) a rear-foot region containing first, second (middle), and third zone of tiles with traction members. That is, the type of traction members (144, 146) in the outsoles is different; however, the geometric configuration of traction members is similar to the non-channeled pattern described above. Non-channeling patterns. This pattern helps provide a shoe with a high traction per volume of traction members and minimal turf-trenching properties for the amount of traction provided.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "top", "bottom", "upper", "lower", "downward", "right", "left", "middle" "proximal", "distal", "lateral", "medial", "anterior", "posterior", and the like are arbitrary terms used to refer to one position of an element based on one perspective and should not be construed as limiting the scope of the invention.

It is understood that the shoe materials, designs, and structures described and illustrated herein represent only some embodiments of the invention. It is appreciated by those skilled in the art that various changes and additions can be made to materials, designs, and structures without departing from the spirit and scope of this invention. It is intended that all such embodiments be covered by the appended claims.

We claim:

1. A golf shoe comprising:

an upper, an outsole, and a midsole connected to the upper and outsole, the upper, midsole, and outsole each having forefoot, mid-foot, and rear-foot regions and lateral and medial sides; and the outsole comprising a first set of spiral pathways (A), each spiral pathway having a point of origin with a plurality of spiral segments radiating from that point, and wherein each segment has a different degree of curvature and contains sub-segments;

a second set of spiral pathways (B), each spiral pathway having a point of origin with a plurality of spiral segments radiating from that point, and wherein each segment has a different degree of curvature and contains sub-segments; and the first set of spiral pathways (A) being normal and the second set of spiral pathways (B) being an inverse of the first set of spiral pathways, so that when the spiral pathways are superposed over each other, the sub-segments of spiral segments from set (A) and the sub-segments of spiral segments from set (B) form four-sided tile pieces on the surface of the outsole, the tile pieces containing protruding traction members.

2. The golf shoe of claim 1, wherein the shoe comprises a first zone of tiles containing protruding traction members extending along a lateral periphery of the forefoot region; a third zone of tiles containing protruding traction members extending along an opposing medial periphery of the forefoot region; and a second zone of tiles containing protruding traction members disposed between the first and third zones.

3. The golf shoe of claim 2, wherein the protruding traction members in the first zone of tiles have a triangular-shaped top surface containing recessed and non-recessed areas, the non-recessed areas forming a ground contacting surface, and wherein the total ground contact surface area is in the range of about 10 to about 35% based on total surface area of the tile.

4. The golf shoe of claim 2, wherein the protruding traction members in the second zone of tiles have a three-sided pyramid-like shape with three sloping surfaces and an apex that forms a ground contacting surface, and wherein the total ground contact surface area is in the range of about 5 to about 40% based on total surface area of the tile.

5. The golf shoe of claim 2, wherein the protruding traction members in the third zone of tiles have a triangular-shaped, non-recessed top surface that forms a ground contacting surface, and wherein the total ground contact surface area is in the range of about 20 to about 60% based on total surface area of the tile.

6. The golf shoe of claim 1, wherein the shoe comprises a zone of tiles containing protruding traction members extending along the mid-foot region, and wherein the protruding traction members have a three-sided pyramid-like shape with three sloping surfaces and an apex that forms a ground contacting surface, and wherein the total ground contact surface area is in the range of about 5 to about 40% based on total surface area of the tile.

7. The golf shoe of claim 1, wherein the shoe comprises a first zone of tiles containing protruding traction members extending along a lateral periphery of the rear-foot region; a third zone of tiles containing protruding traction members extending along an opposing medial periphery of the rear-foot region; and a second zone of tiles containing protruding traction members disposed between the first and third zones.

8. The golf shoe of claim 7, wherein the protruding traction members in the first zone of tiles have a triangular-shaped, non-recessed top surface that forms a ground contacting surface, and wherein the total ground contact surface area is in the range of about 20 to about 60% based on total surface area of the tile.

9. The golf shoe of claim 7, wherein the protruding traction members in the second zone of tiles have a three-sided pyramid-like shape with three sloping surfaces and an apex that forms a ground contacting surface, and wherein the total ground contact surface area is in the range of about 5 to about 40% based on total surface area of the tile.

10. The golf shoe of claim 7, wherein the protruding traction members in the third zone of tiles have a triangular-shaped top surface containing recessed and non-recessed areas, the non-recessed areas forming a ground contacting surface, and wherein the total ground contact surface area is in the range of about 10 to about 35% based on total surface area of the tile.

11. The golf shoe of claim 1, wherein the outsole comprises a rubber composition.

12. The golf shoe of claim 1, wherein the midsole comprises an ethylene vinyl acetate copolymer composition.

* * * * *